US007563203B2

(12) United States Patent
Dalebout et al.

(10) Patent No.: US 7,563,203 B2
(45) Date of Patent: Jul. 21, 2009

(54) TREADMILL WITH ADJUSTABLE CUSHIONING MEMBERS

(75) Inventors: William T. Dalebout, N. Logan, UT (US); Gordon L. Cutler, Providence, UT (US); Rodney L. Hammer, Lewiston, UT (US); Justin Quinn Ferre, Logan, UT (US)

(73) Assignee: Icon IP, Inc., Logan, UT (US)

( * ) Notice: Subject to any disclaimer, the term of this patent is extended or adjusted under 35 U.S.C. 154(b) by 604 days.

(21) Appl. No.: 10/377,295

(22) Filed: Feb. 28, 2003

(65) Prior Publication Data

US 2003/0153434 A1 Aug. 14, 2003

Related U.S. Application Data

(60) Continuation-in-part of application No. 09/953,589, filed on Sep. 12, 2001, now Pat. No. 6,821,230, which is a continuation-in-part of application No. 09/777,141, filed on Feb. 5, 2001, now Pat. No. 6,652,424, which is a continuation of application No. 09/437,387, filed on Nov. 10, 1999, now Pat. No. 6,280,362, which is a division of application No. 09/160,947, filed on Sep. 25, 1998, now Pat. No. 6,174,267.

(51) Int. Cl.
*A63B 22/02* (2006.01)

(52) U.S. Cl. ..... 482/54; 482/51

(58) Field of Classification Search ..... 482/51, 482/54; 119/700

See application file for complete search history.

(56) References Cited

U.S. PATENT DOCUMENTS 3,592,466 A 7/1971 Parsons
3,689,066 A 9/1972 Hagen
4,350,336 A 9/1982 Hanford
4,509,510 A 4/1985 Hook (Continued)

FOREIGN PATENT DOCUMENTS

CN 2387928 7/2000

(Continued)

OTHER PUBLICATIONS

Kutz, M., ed., Mechanical Engineer's Handbook, 2nd ed., New York: John Wiley & Son, Inc., 1998.

(Continued)

*Primary Examiner*—Glenn Richman
(74) *Attorney, Agent, or Firm*—Workman Nydegger

(57) ABSTRACT

An exercise device includes a frame with a deck cooperating with the frame. The deck and frame cooperate with an endless belt having an upwardly exposed exercise section upon which an exercising user may rest or exercise. An impact absorbing mechanism cooperates with the frame and the deck and is configured to adjustably cushion the impact of a user upon the exercise section of the endless belt. The impact absorbing mechanism includes at least cushioning member and at least one spring at least partially surrounding a portion of the at least one cushioning member, wherein adjustment of the impact absorbing mechanism is achieved by replacing at least one of the at least one cushioning member and the at least one spring with at least one of another cushioning member and another spring.

34 Claims, 19 Drawing Sheets

U.S. PATENT DOCUMENTS

| | | | |
|---|---|---|---|
| 4,548,405 | A | 10/1985 | Lee et al. |
| 4,576,376 | A | 3/1986 | Miller |
| 4,616,822 | A | 10/1986 | Trulaske et al. |
| 4,819,583 | A | 4/1989 | Guerra |
| 4,886,266 | A | 12/1989 | Trulaske |
| 4,938,473 | A | 7/1990 | Lee et al. |
| 4,984,810 | A | 1/1991 | Stearns et al. |
| 5,072,928 | A | 12/1991 | Stearns et al. |
| 5,088,729 | A | 2/1992 | Dalebout |
| 5,184,988 | A | 2/1993 | Dunham |
| 5,250,012 | A | 10/1993 | Meredith |
| 5,279,528 | A | 1/1994 | Dalebout et al. |
| 5,330,401 | A | 7/1994 | Walstead |
| 5,336,144 | A | 8/1994 | Rodden |
| 5,344,372 | A | 9/1994 | Hung |
| 5,374,227 | A | 12/1994 | Webb |
| 5,382,207 | A | 1/1995 | Skowronski et al. |
| 5,441,468 | A | 8/1995 | Deckers et al. |
| 5,454,772 | A | 10/1995 | Rodden |
| 5,476,430 | A | 12/1995 | Lee et al. |
| 5,484,362 | A | 1/1996 | Skowronski et al. |
| 5,518,471 | A | 5/1996 | Hettinger et al. |
| 5,527,245 | A | 6/1996 | Dalebout et al. |
| 5,542,892 | A | 8/1996 | Buhler |
| 5,599,259 | A | 2/1997 | Skowronski et al. |
| 5,626,539 | A | 5/1997 | Piaget et al. |
| 5,634,870 | A | 6/1997 | Wilkinson |
| 5,649,882 | A | 7/1997 | Parikh et al. |
| 5,690,587 | A | 11/1997 | Gruenangerl |
| 5,749,807 | A | 5/1998 | Webb |
| 5,752,897 | A | 5/1998 | Skowronski et al. |
| 5,810,696 | A | 9/1998 | Webb |
| 5,827,155 | A | 10/1998 | Jensen et al. |
| 5,976,061 | A | 11/1999 | Moon et al. |
| 5,980,432 | A | 11/1999 | Ahman |
| 5,993,358 | A | 11/1999 | Gureghian et al. |
| 6,013,011 | A | 1/2000 | Moore et al. |
| 6,045,490 | A | 4/2000 | Shafer et al. |
| 6,050,921 | A | 4/2000 | Wang |
| 6,053,848 | A | 4/2000 | Eschenbach |
| 6,068,578 | A | 5/2000 | Wang |
| 6,095,951 | A | 8/2000 | Skowronski et al. |
| 6,132,340 | A | 10/2000 | Wang et al. |
| 6,174,267 | B1 | 1/2001 | Dalebout et al. |
| 6,174,268 | B1 | 1/2001 | Novak |
| 6,179,753 | B1 | 1/2001 | Barker et al. |
| 6,234,936 | B1 | 5/2001 | Wang |
| 6,280,362 | B1 | 8/2001 | Dalebout et al. |
| 6,328,676 | B1 | 12/2001 | Alessandri |
| 6,394,239 | B1 | 5/2002 | Carlson |
| 6,436,008 | B1 | 8/2002 | Skowronski et al. |
| 6,623,407 | B2 * | 9/2003 | Novak et al. ..... 482/54 |
| 6,652,424 | B2 | 11/2003 | Dalebout |
| 6,821,230 | B2 | 11/2004 | Dalebout et al. |
| 6,923,746 | B1 * | 8/2005 | Skowronski et al. ..... 482/54 |
| 7,086,994 | B2 * | 8/2006 | Turak et al. ..... 482/54 |
| 2001/0016543 | A1 | 8/2001 | Dalebout |
| 2001/0024998 | A1 | 9/2001 | Novak et al. |

FOREIGN PATENT DOCUMENTS

| | | |
|---|---|---|
| CN | 99239071.0 | 7/2000 |
| EP | 0 403 924 B1 | 6/1990 |
| EP | 0 504 649 B1 | 3/1992 |
| WO | WO2004/078266 | 9/2004 |

OTHER PUBLICATIONS

Hibbler, R.C., Engineering Mechanics Statics, 4th ed., New York: Macmillan Publishing Company, 1986.

Office action dated Sep. 29, 1999 from U.S. Appl. No. 09/160,947 (4 pages).

Office action dated Jan. 18, 2000 from U.S. Appl. No. 09/160,947 (4 pages).

Notice of Allowance dated Sep. 13, 2000 from U.S. Appl. No. 09/160,947 (1 page).

Issue Notification dated Jan. 16, 2001 from U.S. Appl. No. 09/160,947 (1 page).

Office action dated Mar. 27, 2000 from U.S. Appl. No. 09/437,387 (5 pages).

Notice of Allowance date Oct. 3, 2000 from U.S. Appl. No. 09/437,387 (1 page).

Examiner's Amendment dated May 30, 2001 from U.S. Appl. No. 09/437,387 (2 pages).

Office action dated Aug. 15, 2002 from U.S. Appl. No. 09/777,141 (4 pages).

Notice of Allowance dated Apr. 7, 2003 from U.S. Appl. No. 09/777,141 (4 pages).

Issue Notification dated Nov. 6, 2003 from U.S. Appl. No. 09/777,141 (1 page).

Office action dated Jun. 26, 2003 from U.S. Appl. No. 09/953,589 (3 pages).

Notice of Allowance dated Dec. 15, 2003 from U.S. Appl. No. 09/953,589 (3 pages).

Issue Notification dated Nov. 4, 2004 from U.S. Appl. No. 09/953,589 (1 page).

State Intellectual Property Office of People's Republic of China "Notification of the First Office Action," from Chinese Patent Application No. 200380109989.X dated Aug. 17, 2007 (2 pages) with English translation (3 pages) and with English translation (3 pages) and with "Text of the First Office Action," (6 pages) and partial English translation (7 pages).

* cited by examiner

TREADMILL WITH ADJUSTABLE CUSHIONING MEMBERS

CROSS-REFERENCE TO RELATED APPLICATIONS

This application is a continuation-in-part of U.S. patent application Ser. No. 09/953,589, entitled "Treadmill with Adjustable Cushioning Members," filed Sep. 12, 2001, now U.S. Pat. No. 6,821,230 which is incorporated herein by this reference and which is a continuation-in-part of U.S. patent application Ser. No. 09/777,141 entitled "Treadmill with Adjustable Cushioning Members," filed Feb. 5, 2001, now U.S. Pat. No. 6,652,424 which is incorporated herein by this reference and which is a continuation of U.S. patent application Ser. No. 09/437,387, filed Nov. 10, 1999, now U.S. Pat. No. 6,280,362 entitled "Treadmill with Adjustable Cushioning Members," which is incorporated herein by this reference and which is a divisional of U.S. patent application Ser. No 09/160,947, filed Sep. 25, 1998, now U.S. Pat. No. 6,174,267 entitled "Treadmill with Adjustable Cushioning Members," which is incorporated herein by this reference.

BACKGROUND OF THE INVENTION

1. The Field of the Invention

The present invention relates to treadmills. More specifically, the present invention relates to treadmills with adjustable cushioning members.

2. The Relevant Technology

Treadmills have become increasingly popular in recent years as exercise equipment that is used for either running or walking. Treadmills typically include an exercise platform having an elongate frame with a roller assembly mounted across opposite lateral ends of the frame. A belt is mounted for travel about the roller assembly and is controlled by a motor. The belt is flexible and unable to rigidly support the weight of the user. A user is supported by a deck disposed between the upper portion of the belt and the frame. As the user walks or runs on the belt, the belt is pressed against the underlying deck to provide mechanical support.

Some treadmills include decks that are directly affixed to the frame to provide a rigid support. As a result, the shock delivered to the deck from the user's step is reflected back to the foot, ankle and/or leg of the user in a similar manner as the reactive forces are imposed on a walker, a jogger or a runner exercising on a hard-paved surface or a sidewalk. Over long periods of time, the shock experienced by the user may provide detrimental effects to the joints of the user. Even in the short term, exercising on a rigid surface may prove to be tiring and jarring to a user. Attempts have been made to provide a way to cushion the impact reflected back to a user while still providing a rigid surface to support the belt and the user.

One method of attempting to cushion the impact reflected to a user is to provide an intricate shock absorbing system, which is attached to both the frame and the deck. However, the intricate shock absorbing system has proven to be difficult to manufacture and cost prohibitive. Another method includes attaching rubber blocks or cushioning strips along the length of the frame prior to mounting the deck to the frame. However, the rubber blocks or cushioning strips have proven to perform differently from one user to another due to the individual weight of the users. As a result, at times the cushioning has proven to be insufficient while at other times the cushioning has proven to be excessive, depending on the user. Another method includes the use of elastomeric springs that are positioned between the frame and the deck to provide an amount of resistance that is proportional to the extent that the deck deflected by a user while exercising.

Each user exercising on a treadmill does not cause the same amount of deflection. Furthermore, the amount of cushioning needed also depends upon the exercise that the user performs on the treadmill. For instance, running on the treadmill tends to require more cushioning than walking on the same treadmill. In addition, the amount of cushioning desired varies from user to user according to personal taste. As such, it would therefore be an advancement in the art to provide a treadmill that offers differing amounts of cushioning.

Another problem within the art relates to treadmills that fail to provide adequate cushioning. A treadmill that does not adequately cushion the exercising user may, in some cases, result in user injury due to the forces applied to the user places his or her foot upon the deck of the treadmill. As such, it would therefore be an advancement in the art to provide a treadmill that offers increased amounts of cushioning.

BRIEF SUMMARY OF THE INVENTION

To achieve the foregoing objects, and in accordance with the invention as embodied and broadly described herein a treadmill with an adjustable impact absorbing mechanism is provided. The impact absorbing mechanism is configured to adjustably cushion the impact of a user exercising on the treadmill. The adjustable impact absorbing mechanism allows the user to select an amount of cushioning provided by selectively adjusting the impact absorbing mechanism.

The treadmill includes a frame and an endless belt trained on the frame, where the belt has an upwardly exposed exercise section. A deck is disposed between the exercise section of the belt and the frame. A plurality of cushioning members are positioned on opposing sides of the frame such that each of the cushioning members includes a plurality of portions with different cushioning properties. The cushioning members are optionally configured to be adjustable so as to selectively position a portion of the cushioning members between the frame and the deck and are, in one configuration, mechanically interconnected such that movement of one of the cushioning members results in corresponding movement of the other cushioning members.

One embodiment includes an adjustable, flexible cantilever that includes a flexible arm and a bumper. The arm includes one end that is mounted to the frame and the other end that is freely disposed from the frame. The bumper extends between the free end and the deck. The cantilever also includes a brace mounted to the frame adjacent to the cantilever, where the brace may be selectively moved along the length of the cantilever.

Another embodiment includes an impact absorbing mechanism having a plurality of cushioning members that each rotate in a horizontal plane. Each cushioning member has a plurality of portions, each portion having different cushioning properties. Horizontal rotation of each cushioning member adjusts the amount of cushioning between the deck and frame. The cushioning members may have indicia thereon, e.g., numbers, which may be viewed by a user to determine the amount of cushioning selected.

In another embodiment, the impact absorbing mechanism includes: (i) a spring; and (ii) a screw configured to extend therethrough. The screw is positioned in a hole thatextends through the frame and/or treadmill deck. The pitch of the screw threads and the spring coil frequency correspond such that the screw threads within the inner diameter of the spring. As such, the rotation of the screw selectively extends or contracts the effective length of the spring, depending on the direction of rotation. Thus, adjustment of the screw correspondingly adjusts the degree of cushioning.

In still another configuration, the impact absorbing mechanism includes a first cushioning member that may be at least partially disposed between the deck and the frame of the exercise device. In one embodiment, the first cushioning member extends from the deck toward the frame with one end of the first cushioning member disposed lower than a plane of an upper portion of the frame. Optionally surrounding the first cushioning member is a second cushioning member, with the first cushioning member and the second cushioning member collectively controlling the deflection of the deck as a user exercises thereupon. The first cushioning member and/or second cushioning member may be replaced or removed by releasing one or more fasteners to enable a user to vary the cushioning properties or degree of deflection associated with the deck. Either or both of the first cushioning member and second cushioning member may be replaced with other cushioning members that provide different biases or resistances to deflection of the exercise device's deck. In this manner, a user may individualize the deck deflection of the exercise device by manipulating the impact absorbing mechanism.

Further, allowing the absorbing mechanism to be disposed lower than the upper portion of the frame enables use of a variety of differently sized cushioning members that provide differing cushioning characteristics, such as extra large cushioning members that provide maximum cushioning without raising the overall height of the treadmill. This system efficiently enables increased cushioning, without increasing treadmill height, thereby making the treadmill more convenient to use and store.

Additionally, the absorbing mechanism decelerates the user as he or she impacts the deck. The time and distance taken to decelerate the user reduces the impact force applied to the user. Stated another way, the absorbing mechanism provides a time delay between a user placing his or her foot upon the deck of the treadmill and termination of the deck moving in the direction of the frame of the treadmill. This time delay may be achieved by increasing the distance traveled by the treadmill deck toward the treadmill frame as the user exercises upon the deck and/or varying the cushioning characteristics of the absorbing mechanism. This time delay reduces the application of a substantially immediate impact force upon the legs of the user as he or she exercises upon the exercise device. The graduated application of the impact force reduces the intensity of the force and reduces the potential for user injury.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
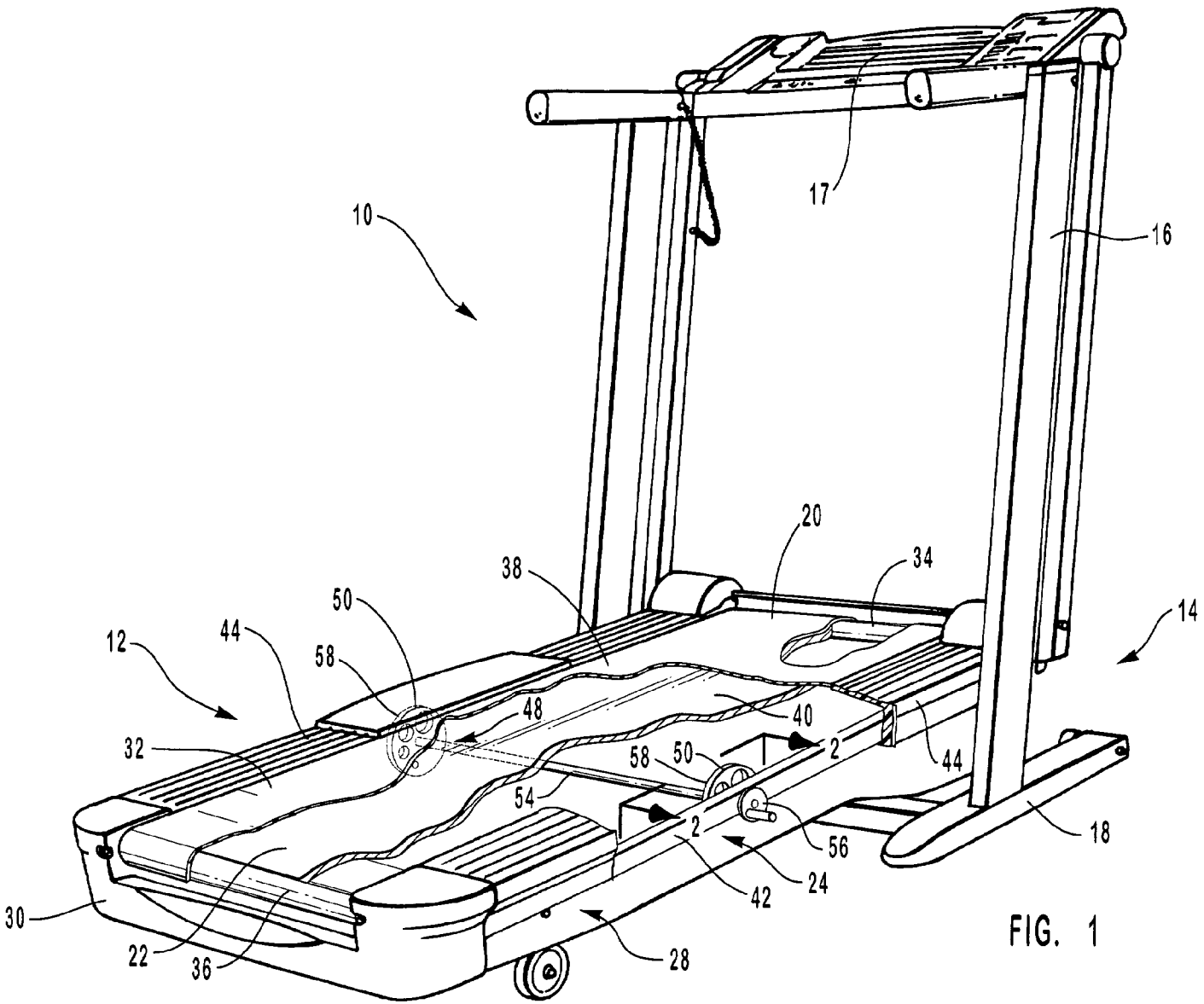
FIG. 1 is partial cutaway perspective view of a treadmill having an exemplary embodiment of a cushioning mechanism.

The present invention relates to treadmills with an impact absorbing mechanism that is configured to selectively adjust the cushioning of a user's impact. Depicted in FIG. 1 is one embodiment of a treadmill that incorporates one or more the features of one embodiment of the present invention. The adjustable impact absorbing mechanism in the present invention allows a user to select the amount of cushioning that will be provided by selectively adjusting the impact absorbing mechanism to individualize the amount of cushioning for a specific user as well as for a particular type of exercise. The adjustments made by a user to the impact absorbing mechanism are typically achieved without any disassembly of the treadmill.

As illustrated in FIG. 1, one embodiment of a treadmill 10 includes an exercise base 12 and a support structure 14. Support structure 14 includes a handrail 16 that extends upwardly from exercise base 12 and means for supporting treadmill 10 upon a support surface such as a floor. One example of such means is illustrated as feet 18, which are located on both the right side of handrail 16 and on the left side of handrail 16, wherein left and right are defined when a user is facing support structure 14 while standing on exercise base 12.

Handrail 16 may include an optional control console 17 that is attached to the upper end of handrail 16 and extends laterally over exercise base 12. Console 17 may have an operating control such as an actuator switch to operate treadmill 10 and a means for indicating a status of the exercise device and/or the user operating the exercise device that may be operated by the user to determine various parameters associated with the exercise being performed. Console 17 may also include a cup or glass holder so that the user may position liquid refreshment for use during the course of performing the exercise. Those skilled in the art will appreciate that various embodiments of consoles may be used. In fact, console 17 may only include on/off switch and therefore may be completely replaced by a lateral support member.

Exercise base 12 includes a front end 20 and a back end 22. As illustrated in FIG. 1, front end 20 of exercise base 12 is attached to support structure 14 and is rotatably attached to support structure 14 such that exercise base 12 may be rotated between an operational position, (illustrated in FIG. 1) and a storage position in which exercise base 12 is substantially vertical. Those skilled in the art will appreciate that various other methods of attaching exercise base 12 to support structure 14 may carry out the intended function thereof. In addition, there is no requirement that exercise base 12 be rotatable. It is contemplated that exercise base 12 may be fixedly attached to support structure 14.

Referring to FIG. 1, exercise base 12 includes a frame 24 that includes a right frame member 28 and a left frame member (not shown). In FIG. 1, however, only the right side of treadmill 10 is visible. It is intended that the left side of frame 24 be a mirror image of the structure discussed relative to the right side. Right frame member 28 and left frame member (not shown) are in a spaced-apart, longitudinal relationship and are substantially parallel. Exercise base 12 also includes a rear support member 30 that is attached to right frame member 28 and left frame member (not shown) at back end 22 of exercise base 12.

Exercise base 12 includes a front roller 34 and a back roller 36 that are attached laterally near front end 20 and back end 22 of frame 24, respectively. An endless belt 32 is trained over front roller 34 and back roller 36 and is positioned between right frame member 28 and left frame member (not shown) so that belt 32 includes an upwardly exposed exercise section 38 upon which a user exercises.

Figure 2:
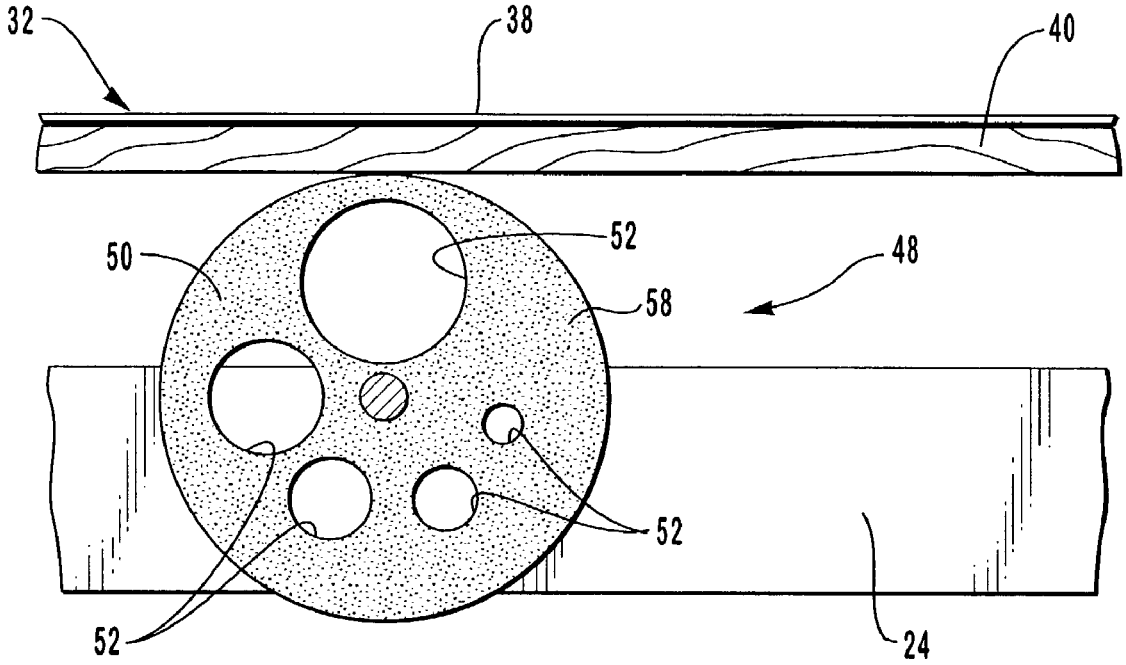
FIG. 2 is a partial cross-sectional elevation view of the cushioning mechanism shown in FIG. 1 taken along section line 2-2 therein.

As depicted in FIGS. 1 and 2, exercise base 12 includes a deck 40 that is disposed between exercise section 38 of belt 32 and frame 24. Deck 40 is substantially rigid and provides a rigid support to a user exercising on exercise section 38 of belt 32. Although deck 40 is identified as being substantially rigid, one skilled in the art may appreciate that deck 40 may flex to some degree, to reduce the impact forces applied to a user's joints during exercise activities, such as, but not limited to, walking, running, jogging, and other similar related activities. Treadmill 10 may also be used for stationary exercises such as stretching or bending while the user is standing on belt 32.

In one embodiment, front end 20 and/or back end 22 of deck 40 are not secured to the frame. Instead, end 20 and/or 22 move freely from frame 24 to permit a greater adjustment of cushioning. For example, in one embodiment, back end 22 of deck 40 is secured to frame 24 (through the use of screws, or similar connectors), but the front end 20 of deck 40 is not secured to frame 24. As such, front end 20 deflects freely from frame 24 to permit a greater adjustment of cushioning applied to front end 20 of deck 40.

However, in another embodiment, both front end 20 and back end 22 of deck 40 are secured to frame 24 and an adjustable cushioning is applied to the central portion of deck 40 between opposing ends 20 and 22. Optionally, the adjustable cushioning may be applied in front and/or behind the points of securement of deck 40 to frame 24.

One embodiment of right frame member 28 and left frame member (not shown) includes a side rail 42 and a side platform 44. As illustrated in FIG. 1, side platform 44 is positioned over the top of side rail 42 of both right frame member 28 and left frame member (not shown). Side platforms 44 are positioned on each side of belt 32 and are capable of supporting the weight of a user standing thereon.

The position of side platforms 44 are such that a user of treadmill 10 may comfortably and easily step off of belt 32 onto one or both of side platforms 44. A user may also stand on side platform 44 on either side of exercise base 12 until he or she is ready to step onto belt 32. It may be appreciated that other embodiments of frame 24 that include right frame member 28 and left frame member (not shown) or the components thereof may carry out the intended function thereof.

The present invention includes an impact absorbing mechanism 48 that is configured for manual adjustment to provide selectable amounts of impact cushioning when a user is operating on exercise section 38 of belt 32. Impact absorbing mechanism, which is an example of an impact absorbing means for providing selectable amounts of impact cushioning, allows the amount of cushioning provided by treadmill 10 to be manually adjusted to individualize treadmill 10 for different uses and/or users.

One embodiment of impact absorbing mechanism 48 is depicted in FIGS. 1 and 2. In FIG. 1, impact absorbing mechanism 48 includes a plurality of cushioning members 50 that are positioned between deck 40 and frame 24. Although FIG. 1 illustrates two (2) cushioning members 50, it may be appreciated that various other numbers of cushioning members 50 may be used. Cushioning members 50 are attached to opposing sides of frame 24 and are at least partially disposed between frame 24 and deck 40. Cushioning members 50 are substantially opposite to each other on frame 24 and are substantially perpendicular to deck 40. Cushioning members 50 include a plurality of portions having different cushioning properties. In FIG. 1, cushioning members 50 are attached to the inside surface of frame 24. It is contemplated, however, that cushioning members 50 may be attached to the outside surface of frame 24 and perform similar function to the embodiments described herein.

Cushioning members 50 include flexible bases 58 that include apertures 52 of varying sizes. As the size of aperture 52 increases, the stiffness of that portion of base 58 cushioning members 50 decreases. As a result, the size of aperture 52 in base 58 of cushioning members 50 is related to the flexibility provided by that portion of cushioning members 50. The portions of cushioning member 50 include different cushioning properties due to the varying size of the apertures to allow a user of treadmill 10 who may desire less cushioning, for example, to manually adjustably position cushioning members 50 so that the portion of cushioning members 50 with the smallest aperture 52 and, therefore, the least flexibility is proximate to deck 40. In this position, cushioning members 50 have an increased stiffness that results in less cushioning. In contrast, when more cushioning is desired, cushioning members 50 are rotated to adjust cushioning members 50 so that a portion of bases 58 with progressively increasing sized apertures is against deck 40 to increase the flexibility and cushioning of cushioning members 50.

As shown in FIGS. 1 and 2, bases 48 of cushioning members 50 are configured in a disk-like shape. While bases 58, as shown, are substantially planar, it is not required that bases 58 be planar. Instead, bases 58 may have various other configurations such as elliptical, oval, octagonal, polygonal, or any other configuration so long as base provides various levels of flexibility and cushioning. The shape of bases 58 is not particularly important since various other configurations of bases 58 may carry out the intended function thereof. What is important is that bases 58 of cushioning members 50 have portions of differing amounts of stiffness to correspondingly provide different amounts of cushioning in absorbing the impact between deck 40 and frame 24 when a user is operating on exercise section 38 of belt 32. Cushioning members 50 provide selectable amounts of impact cushioning.

As illustrated in FIG. 1, impact absorbing mechanism 48 also includes means for selectively adjusting cushioning members 50 so as to selectively position one of the plurality of portions of cushioning members 50 between frame 24 and deck 38. For example, manually a user may be able to physically move or rotate cushioning members 50 or press a button on console 17 to cause cushioning members 50 to be automatically and selectively adjusted to provide the desired amount of cushioning.

One example of a structure capable of performing the function of such a means for selectively adjusting cushioning members 50 includes a handle 56. As depicted in FIG. 1, one embodiment of handle 56 is mounted outside frame 24 and is attached to one of cushioning members 50. Handle 56 is configured to cooperate with frame 24. Other embodiments of handle 56 perform the function thereof. For example, handle 56 may be a knob attached to base 58 of one of cushioning members 50, particularly if cushioning members 50 are attached to the outside surface of frame 24. Handle 56 may be elongated, oval, round, square, polygonal, or may include various other geometric shapes. Handle 56 must just be something that the user may easily grasp. Other embodiments of handle 56 may include some type of an elongated lever or rod. If means for selectively adjusting cushioning members 50 is mounted on console 17, it may include a button that is indexed to automatically and incrementally adjust cushioning members 50 to the specific amounts of cushioning. Other embodiments of means for selectively adjusting cushioning members 50 may be a lever that is slidable on console 17 or a knob attached to console 17 that may be selectively rotated. The knob, the lever, or some other device may be moved on the console 17 by the user to position bases 58 of cushioning members 50 to corresponding positions to provide the selected amount of cushioning.

Impact absorbing mechanism 48 may optionally include means for mechanically interconnecting cushioning members 50 such that movement of one of cushioning members 50 results in corresponding movement of the other second cushioning members 50 and/or other cushioning members forming part of the exercise device. One embodiment of structure capable of performing the function of such a means for mechanically interconnecting a plurality of cushioning members 50 includes an elongated axle 54, as depicted in FIG. 1. Axle 54 is attached to cushioning members 50 and extends laterally therebetween. As the user of treadmill 10 adjusts one of cushioning members 50 using handle 56 to select the desired amount of cushioning, axle 54 translates the movement to the remaining cushioning members 50. Consequently, all of cushioning members 50 move substantially simultaneously to the selected position to provide the desired amount of cushioning.

As illustrated, axle 54 is substantially round. Axle 54 could, however, have other embodiments such as a square, an oval, a rectangle, a polygon, or another shape. Various other configurations or embodiments of means for mechanically interconnecting first and second cushioning members 50 and optionally one or more other cushioning members, are capable of performing the function thereof. In another configuration, means for mechanically interconnecting cushioning members 50 may include a linkage or a cable as will be discussed in further detail below.

In those embodiments of impact absorbing mechanism 48 that do not include a means for mechanically interconnecting cushioning members 50, all of cushioning members 50 have means of adjusting cushioning member 50 so as to selectively position or select one of the plurality of portions 58 of cushioning member 50 between frame 24 and deck 40. For example, as depicted in FIG. 1, first and second cushioning members 50 may each have a handle, such as handle 56, attached thereto. This embodiment would require a user to first make the adjustment to first cushioning member 50 located on one side of treadmill 10 and then move to the opposite side to manually adjust second cushioning member 50 or vice versa. The drawback with this embodiment is in that a user might forget to adjust cushioning members 50 on the opposite side or may inadvertently adjust only cushioning members 50 on one side of treadmill 10 resulting in cushioning members 50 having different settings.

A variety of different adjustable cushioning members may be provided along the length of the base 12 in order to provide a substantially horizontal deck 40. It is also possible to employ both adjustable and non-adjustable cushioning members between frame 24 and deck 40 in order to provide a substantially horizontal deck 40.

The remaining figures illustrate other embodiments of impact absorbing mechanisms and cushioning members. The majority of features previously discussed relative to FIGS. 1 and 2 apply to the remainder of the figures.

Figure 3:
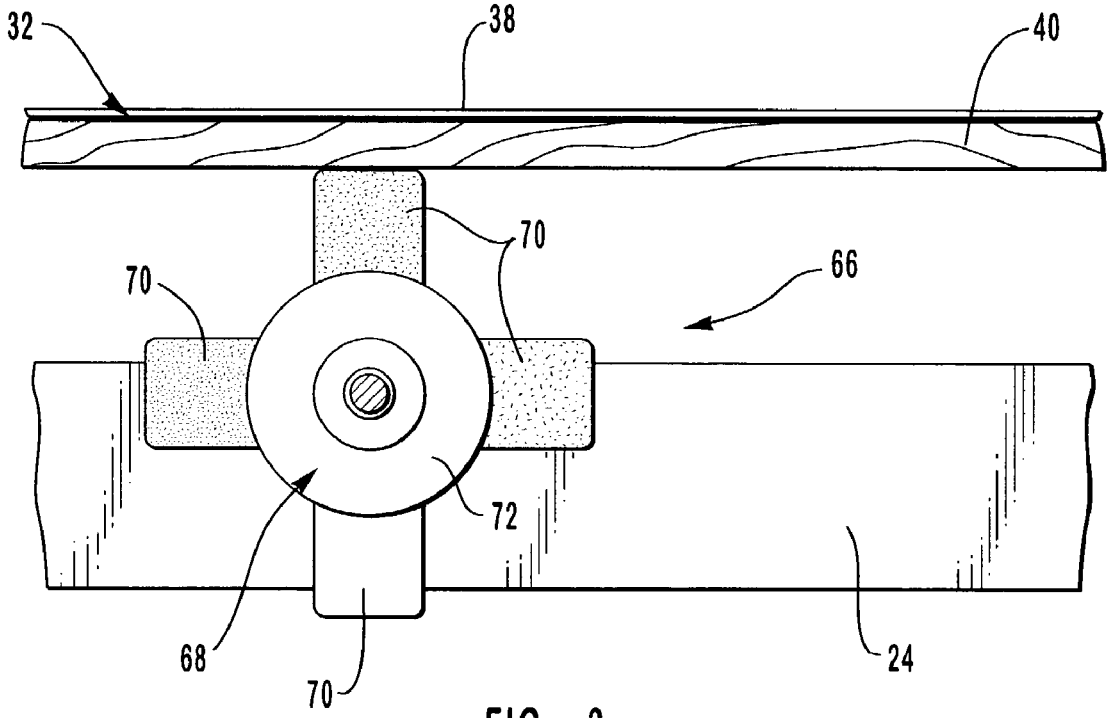
FIG. 3 is a partial cross-sectional elevation view of another exemplary embodiment of a cushioning mechanism.

FIG. 3 depicts another embodiment of impact absorbing mechanism 66. One of a plurality of cushioning members 68 is shown in FIG. 3. Impact absorbing mechanism 66 includes a plurality of substantially identical cushioning members 68 that are movably attached to frame 24 and are substantially perpendicular to deck 40. As with cushioning members 50, cushioning members 68 each may be attached either inside or outside frame 24.

Cushioning members 68 include a plurality of portions having different cushioning properties. Cushioning members 68 each include a base 72 having a plurality of arms 70 projecting therefrom. In the embodiment depicted in FIG. 3, base 72 is substantially round. Various other configurations of base 72 are possible, while still performing the desired function. Base 72 could, for example, alternatively be square, oval, elliptical, octagonal, triangular, polygonal, or another shape. Arms 70 project radially from base 72. While FIG. 3 illustrates that cushioning members 68 have four (4) arms 70, it is contemplated that any number of arms 70 other than one (1) may be utilized. What is important is that the user may manually adjust cushioning members 68 to select between differing amounts of cushioning.

Arms 70 of cushioning members 68 are made of various materials with each having a different stiffness characteristic such that each of arms 70 experiences a differing amount of deflection when contacting deck 40 in response to a force from the impact of a user on exercise section 38 of belt 32. In one embodiment of cushioning members 68, arms 70 may be substantially comprised of materials selected from the group consisting of plastic, hard rubber, soft rubber, and cellular foam. Various other kinds of materials that have differing stiffness characteristics may alternatively be used. In addition, although depicted in FIG. 3 as being substantially rectangular, arms 70 may have other configurations such as being square, semispherical, half an ellipse, half an oval, polygonal, or a truncated cone and perform the desired function thereof.

Figure 4:
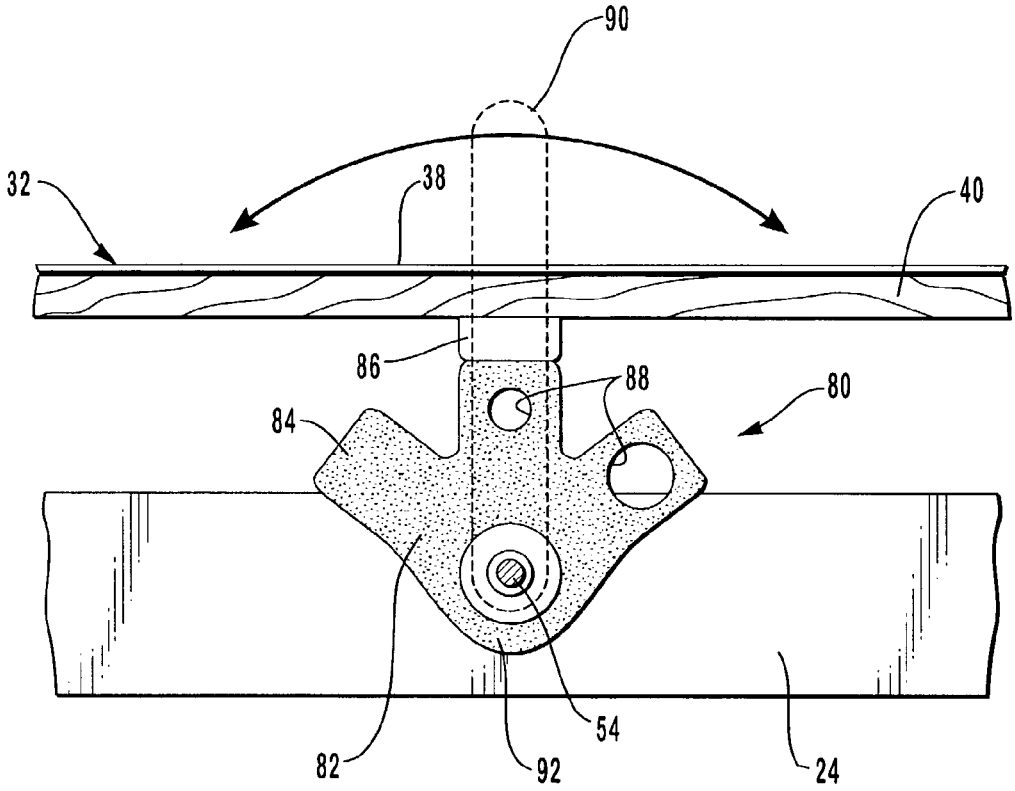
FIG. 4 is a partial cross-sectional elevation view of another exemplary embodiment of a cushioning mechanism.

FIG. 4 illustrates another embodiment of an impact absorbing mechanism 80 that includes cushioning members 82. Like cushioning members 50 and 68 depicted in FIGS. 1-3, cushioning members 82 are movably attached to frame 24 and may be disposed substantially perpendicular to deck 40. Cushioning members 82 include a plurality of portions having different cushioning properties. Cushioning members 82 include a base 92 with arms 84 extending therefrom. In this embodiment, cushioning members 82 are substantially fan-shaped. Like cushioning members 68 depicted in FIG. 3, cushioning members 82 have arms 84 extending outwardly from base 92. In this embodiment, as illustrated in FIG. 4, cushioning members 82 have three (3) arms 84. As previously mentioned, cushioning members 82 could, however, have various other numbers of arms 84.

Although cushioning members 68 and 92 illustrated in FIGS. 3 and 4 have arms 70 and 84, respectively, that are parallel to bases 72 and 92, respectively, arms 70 and 84 are not required to be parallel to bases 72 and 82. Instead, bases 72 or 92 could be mounted on frame 24 so as to be substantially parallel with deck 40. Arms 70 or 84 while extending outwardly from bases 72 or 92 now extend upward toward deck 40. For example, arms 70 and 84 could be "L-shaped." This embodiment of cushioning members performs the function thereof equally effectively.

Impact absorbing mechanism 80 includes an optional raised portion 86 on deck 40 that extends away from deck 40 toward frame 24. Raised portion 86 is configured to cooperate with arms 84 on cushioning members 82. Alternatively, raised portion 86 of deck 40 may be eliminated and arms 84 of cushioning members 82 may extend to directly contact deck 40 as in the embodiment illustrated in FIG. 3.

Impact absorbing mechanism 80 with cushioning members 82, as depicted in FIG. 4, are somewhat similar to the embodiment of cushioning members 50 illustrated in FIG. 2. Like the embodiment depicted in FIG. 2, arms 84 or base 92 of cushioning members 82 have differently sized openings 88 formed therein and form a plurality of portions in cushioning members 82 having differing cushioning properties. Openings 88 are differently sized and, as a result, arms 84 each have differing amounts of stiffness. As shown, one of arms 84 of cushioning members 82 does not have an opening 88 that changes the stiffness of that arm 84. What is important is that each arm 84 has a discrete and differing amount of flexibility and deflection in response to a user exercising on belt 32 as a result of the differing stiffness. Cushioning members 82, consequently, will provide a differing amount of cushioning depending on which of arms 84 is in contact with deck 40.

Impact absorbing mechanism 80 also includes an elongated lever 90, as shown in phantom in FIG. 4, configured to manually adjust cushion members 82. Lever 90 is one embodiment of structure capable of performing the function of means for selectively adjusting cushioning members 82 so as to selectively select one of the plurality of portions of cushioning members 82 between frame 24 and deck 40.

Figure 5:
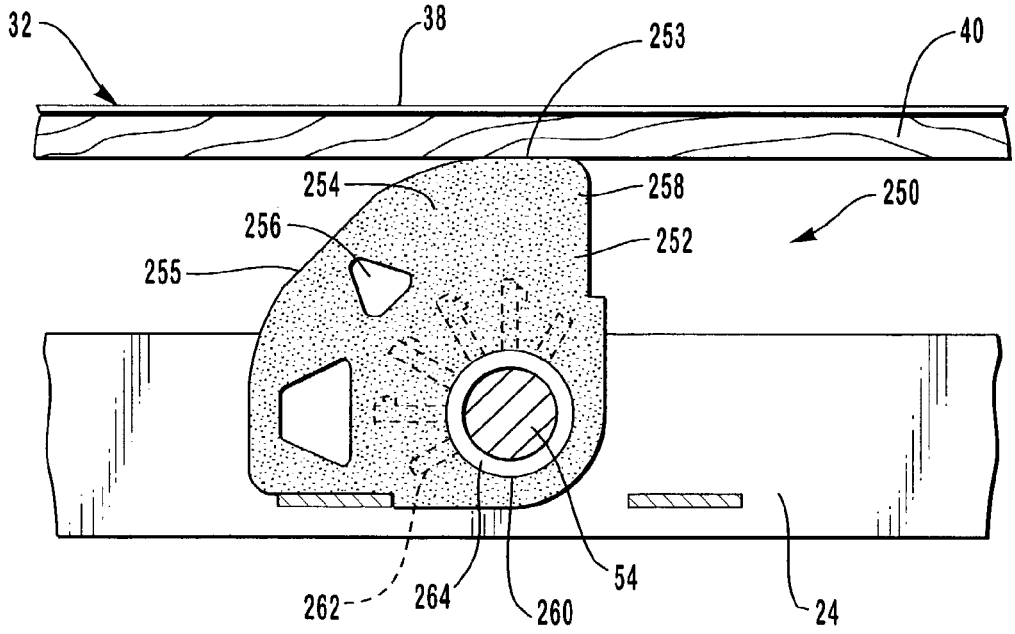
FIG. 5 is a partial cross-sectional elevation view of another exemplary embodiment of a cushioning mechanism.

FIG. 5 illustrates another embodiment of an impact absorbing mechanism 250 that includes cushioning members 252. Like the cushioning members depicted in FIGS. 1-4, cushioning members 252 are movably attached to frame 24 and are disposed substantially perpendicular to deck 40. Cushioning members 252 include a plurality of portions 258 having different cushioning properties. Cushioning members 252 include a substantially fan-shaped base 254 having different flattened surfaces 255 extending around the rim 253 of base 254.

Base 254 of cushioning members 252 has differently sized openings 256 formed therein, forming a plurality of portions 258 in cushioning members 252 having differing cushioning properties. Openings 256 are differently sized and as a result, different portions 258 of base 254 have differing stiffness. As shown, one of the portions 258 of cushioning members 252 does not have an opening 256 formed therein. This further changes the stiffness of that portion 258. What is important is that each portion has discrete and differing amount of flexibility and deflection in response to a user exercising on belt 32 as a result of the differing stiffness. Cushioning members 252, consequently, will provide a differing amount of cushioning depending on which portion contacts deck 40.

Impact absorbing mechanism 250 also includes a hub 260 coupling base 254 to axle 54. Hub 260 includes fingers 262 (shown in phantom lines) extending radially from a hub sleeve 264 disposed about axle 54 and coupled to axle 54 through the use of a screw (not shown) disposed through sleeve 264 and axle 54. In one embodiment, base 254 includes a flexible polyvinylchloride material that is molded onto a nylon or glass-filled nylon hub 260. By way of example, the polyvinylchloride material may have a durometer of about 65, shore A.

In one embodiment, impact absorbing mechanism 250 is positioned toward front end 20 of base 12, e.g., within the front one-third of base 12. This positioning is particularly useful when front end 20 of deck 40 is not secured to frame 24, e.g., when back end 22 of deck is secured to frame 24 (through the use of screws, for example), while front end 20 moves freely from frame 24. Allowing front end 20 to freely deflect from frame 24 enhances the ability to adjust the amount of cushioning applied to deck 40. In one such embodiment, front end 20 of deck 40 also rests on at least one additional cushioned member, such as an isolator coupled to each side of frame 24, such as discussed below with reference to FIG. 11.

Figure 6A:
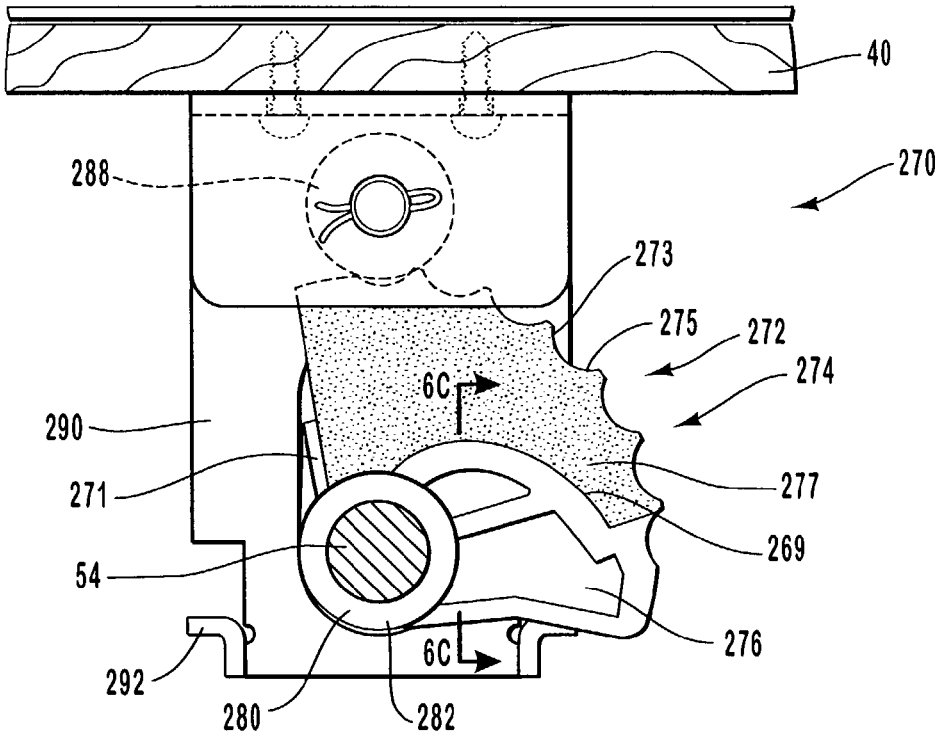
FIGS. 6A-6C feature partial cross-sectional elevation views of another exemplary embodiment of a cushioning mechanism.
Figure 6B:
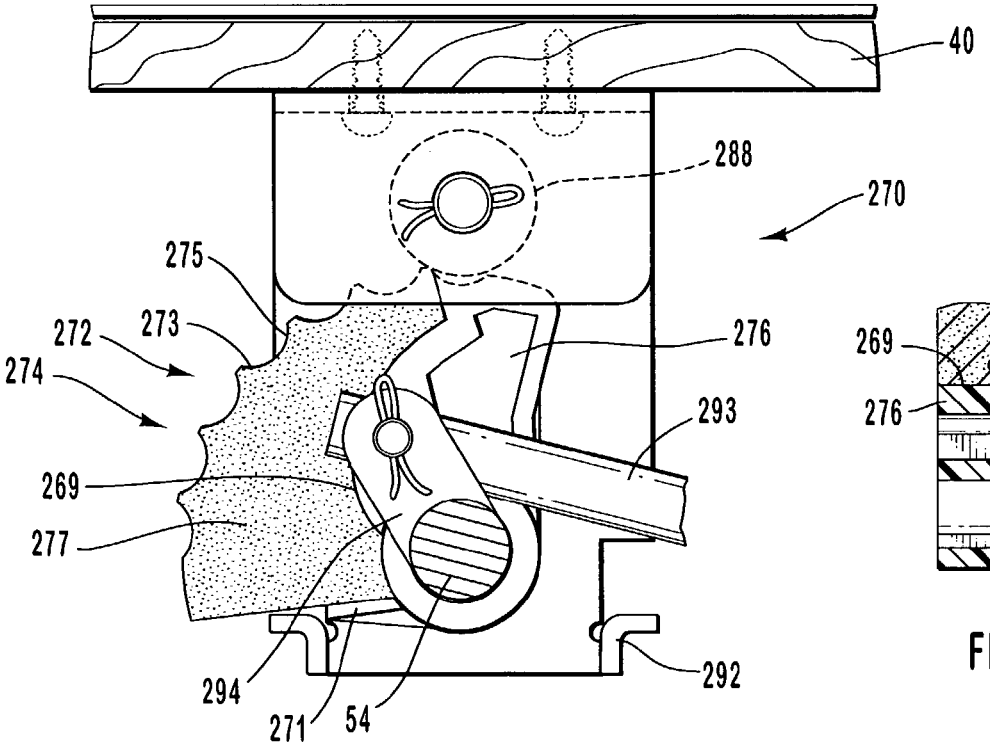
Figure 6C:
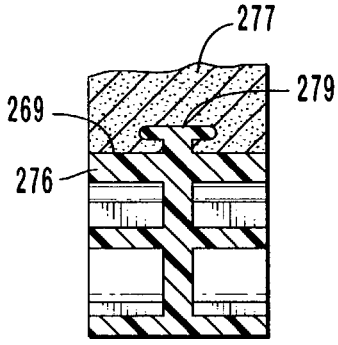

FIGS. 6A-6C illustrate another embodiment of an impact absorbing mechanism 270 that includes cushioning members 272. Cushioning members 272 are movably attached to frame 24 and are disposed substantially perpendicular to deck 40. Cushioning members 272 include a plurality of portions having different cushioning properties. Each cushioning member 272 includes a substantially fan-shaped base 274 having a plurality of recesses 275 extending around rim 273 of base 274.

Base 274 of cushioning member 272 includes a flexible portion 277 attached through adhesion or molding to a substantially more rigid portion 276, forming a plurality of portions in cushioning members 272 having differing cushioning properties. As a result, different portions of base 274 have differing stiffness. Cushioning members 272, consequently, will provide a differing amount of cushioning depending on which portion contacts a wheel 288 pivotally coupled to deck 40, as discussed below.

Impact absorbing mechanism 270 also includes a hub 280 coupling base 274 to axle 54. Hub 280 includes a hub sleeve 282 coupled to base 274. In one embodiment, hub sleeve 282 is integrally coupled to member 276 and to a plate 271, such that flexible portion 277 is cradled within plate 271, hub 280 and member 276.

Hub sleeve 282 is disposed about axle 54 and coupled to axle 54 using a screw (not shown) disposed through sleeve 282 and axle 54, for example. In one embodiment, flexible portion 277 includes a flexible polyvinylchloride material that is molded onto a significantly more rigid nylon or glass-filled nylon member 276 and plate 271. Hub 280 may also include nylon or glass-filled nylon. By way of example, and not limitation, the polyvinylchloride material may have a durometer of about 55, shore A.

Impact absorbing mechanism 270 further includes wheel 288 rotatably coupled to deck 40. In one embodiment, a bracket 290 couples wheel 288 to deck 40. Wheel 288 is configured to mate with a selected recess 275 on cushioning member 272. Wheel 288 turns as cushioning member 272 turns. This assists in preserving the material of cushioning member 272 from damage as member 272 is turned. Stops 292 coupled to bracket 290 prevent the over-rotation of cushioning member 272.

As yet another feature of impact absorbing mechanism 270, as shown in FIG. 6B, axle 54 includes a tab 294 coupled to axle 54. In a preferred embodiment, a motor, such as an extension motor, has an arm 293 pivotally coupled to tab 294. Upon actuating the motor, such as by pressing a button coupled to the console of the treadmill, the motor rotates axle 54. The button and motor pivotally coupled to axle 54 serve as another example of a structure capable of performing the function of means for selectively adjusting cushioning members 272 so as to select one of the plurality of portions of cushioning members 272 between frame 24 and deck 40.

In one embodiment, impact absorbing mechanism 250 is positioned toward front end 20 of base 12, e.g., within the front one-third of base 12. One or both of front and back ends 20, 22 of deck 40 may be secured to frame 24.

As shown in FIG. 6C, in one embodiment, rigid portion 276 includes a rim 269 having a T-shaped member 279 extending therefrom. Member 279 is covered by flexible portion 277 and enhances the adhesion of flexible portion 277 to the more rigid portion 276.

Figure 7:
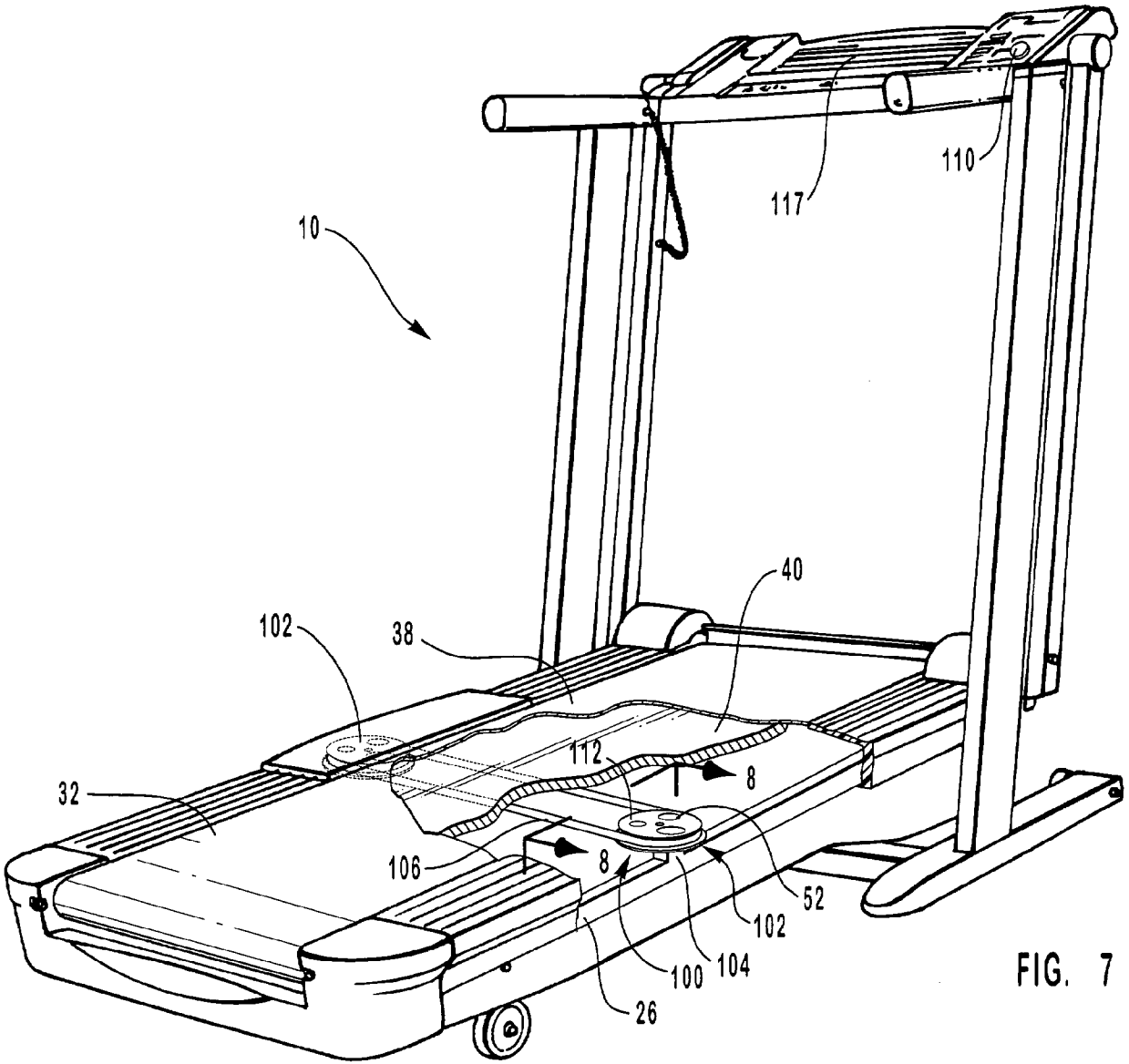
FIG. 7 is a partial cutaway perspective view of a treadmill having another exemplary embodiment of a cushioning mechanism.
Figure 8:
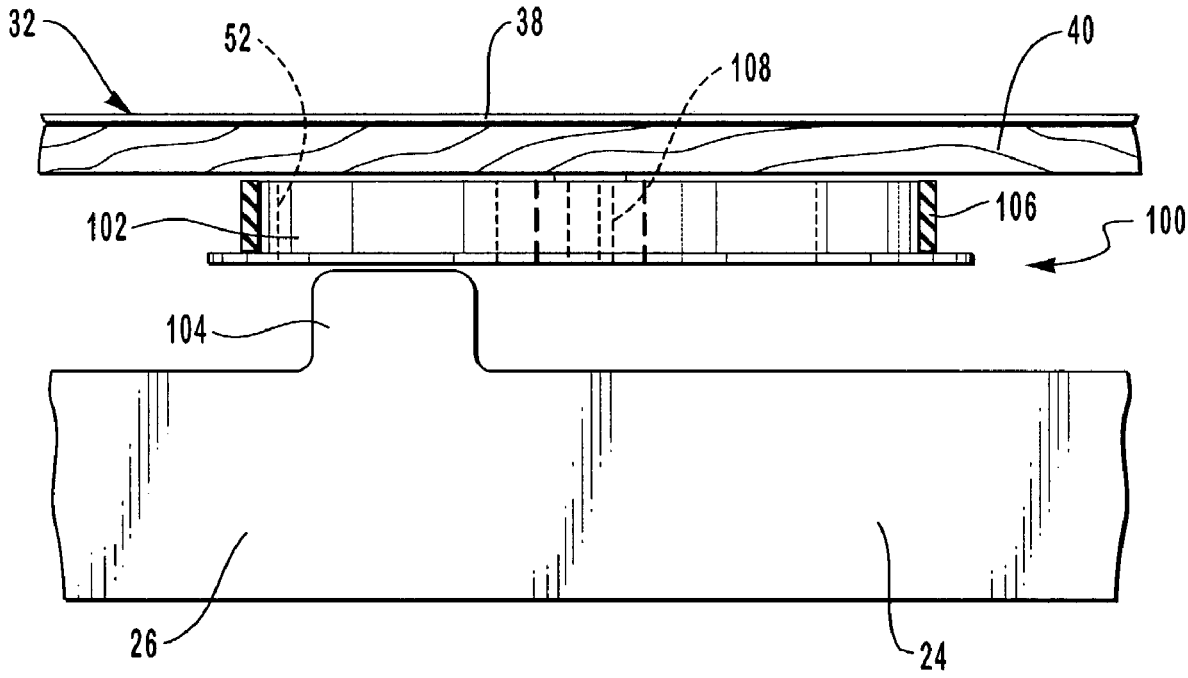
FIG. 8 is a partial cross-sectional elevation view of the cushioning mechanism of FIG. 7 taken along section line 8-8 therein.

FIGS. 7 and 8 depict treadmill 10 with another embodiment of an impact absorbing mechanism 100 configured for manual adjustment to provide selectable amounts of impact cushioning when a user is operating on exercise section 38 of belt 32. Impact absorbing mechanism 100 includes cushioning members 102. As shown in FIG. 8, cushioning members 102 are substantially parallel to deck 40 and are at least partially disposed between deck 40 and frame 24. Cushioning members 102 may be movably attached to either deck 40 or frame 24. As depicted in FIG. 8, cushioning members 102 are rotatably attached to deck 40 by a vertical axle 108.

Right frame member 26 and left frame member (not shown) of frame 24 have raised portions 104 formed thereon. Raised portions 104 extend upwardly towards deck 40 and contact cushioning members 102. Cushioning members 102 illustrated in FIGS. 7 and 8 have substantially the same configuration as cushioning members 50 depicted in FIGS. 1 and 2. Cushioning members 102 include a plurality of portions having different cushioning properties. Cushioning members 102 include a base 112 with a plurality of openings 52 formed therein. Bases 112 of cushioning members 102 are shown as round, but it is intended, particularly in this embodiment, that cushioning members 102 may have various other shapes without effecting the function thereof. Cushioning members 102 may be square, rectangular, polygonal, oval, or various other configurations.

As depicted in FIG. 7, treadmill 10 has a knob 110 on console 117 that causes cushioning members 102 to be selectively adjusted according to the desired amount of cushioning. Knob 110 on console 117 is one embodiment of structure capable of performing the function of a means for selectively adjusting cushioning members to provide differing amount of impact cushioning. Various other embodiments of structure capable of performing the function of such a means for selectively adjusting cushioning members are known to those skilled in the art in light of the teaching contained herein, including, but not limited to, those disclosed with respect to other embodiments of cushioning members.

Impact absorbing mechanism 100 also includes a linkage or a cable 106, shown in FIG. 7, configured to mechanically interconnect cushioning members 102 such that movement of one cushioning member 102 results in corresponding movement of other cushioning members 102. Various embodiments of structure capable of performing the function of such means for mechanically interconnecting cushioning members 102, including those disclosed with other embodiments of cushioning members, are known to those skilled in the art in light of the teaching contained herein. For example, horizontal axle 54 may be mechanically interconnected with vertical axles 108 of cushioning members 102 such that movement of one of cushioning members 102 results in corresponding movement of other cushioning members 102.

Although bases 112 of cushioning members 102 are depicted as having variously sized openings 52, other embodiments of cushioning members 102 perform the desired function thereof. For example, instead of openings 52 formed in bases 112 of cushioning members 102, raised pads comprising materials with different cushioning properties may be mounted on cushioning members 102. Cushioning members 102 may be selectively adjusted such that the raised pads mounted on cushioning members 102 are selectively positioned on raised portion 104. In addition, instead of cushioning members 102 being pivotally mounted below deck 40, cushioning members 102 may be movably attached to frame 24 by vertical axles.

Figure 9:
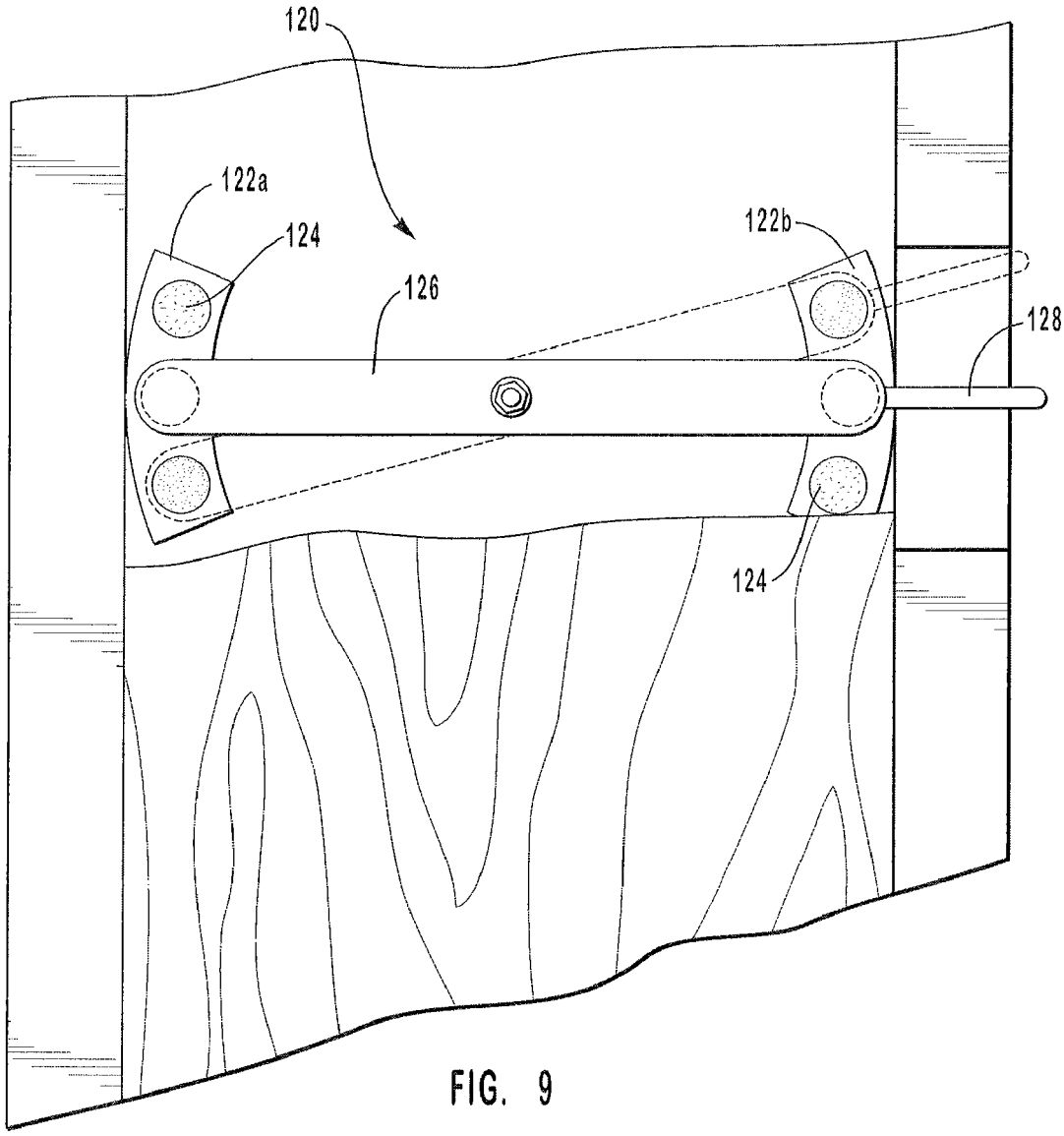
FIG. 9 is a partial cutaway top elevation view of another exemplary embodiment of a cushioning mechanism.

Another embodiment of an impact absorbing mechanism 120 is depicted in FIG. 9. Impact absorbing mechanism 120 includes cushioning members 122 attached to opposite sides of frame 24. Cushioning members 122 are elongated and in the embodiment shown in FIG. 9 are substantially curved. Various other configurations, however, perform the desired function. For example, cushioning members 122 may be rectangular, square, polygonal, semispherical, half an oval, half-an-ellipse, or semicircular. As illustrated, cushioning members 122 include bases 30 that have a plurality of raised pads 124 mounted thereon. Raised pads 124 each include a material with different cushioning properties. The arrangement of raised pads 124 on cushioning members 122*a* on one side of the exercise device is in an inverse mirror image configuration with respect to cushioning members 122*b* on the opposite side of frame 24, as will be discussed in more detail below.

Impact absorbing mechanisms 120 also include an elongated beam 126 movably mounted below deck 40. Beam 126 extends across frame 24 and is substantially parallel to deck 40. A portion of beam 126 is disposed between deck 40 and cushioning members 122 to contact the various raised pads 124. Beam 126 is pivotally connected to deck 40. Raised pads 124 are arranged on cushioning members 122, or 122*a* and 122*b*, so that beam 126 is pivoted to contact one type of raised pad 124 on cushioning members 122 and an opposite end of beam 126 contacts the same material on the opposite of cushioning members 122, as illustrated in FIG. 9.

Beam 126 is another embodiment of structure capable of performing the function of such means for mechanically interconnecting the plurality of cushioning members 122. Beam 126 has an elongated handle 128 attached to one end thereof for the user to grasp to selectively, manually adjust the amount of cushioning provided by cushioning members 122. A user of treadmill 10 may move beam 126 by moving handle 128 until beam 126 contacts the selected raised pads 124 to obtain differing amounts of cushioning of the impact. FIG. 9 illustrates in phantom an example of another position of beam 126 for a differing amount of cushioning. Handle 128 extends away from beam 126 above frame 24. Handle 128 is one example of structure capable of performing the function of means for selectively positioning one of the plurality of portions of cushioning members.

The cushioning members described herein are exemplary embodiments of structures capable of performing the function of means for selectively adjusting the cushioning impact between deck 40 and frame 24.

Figure 10:
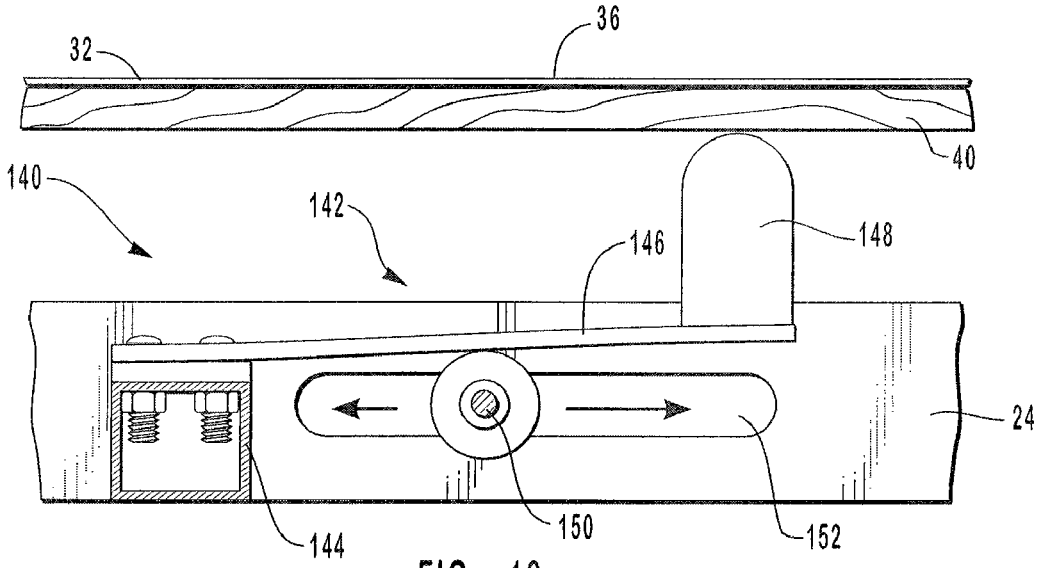
FIG. 10 is a partial cross-sectional elevation view of another exemplary embodiment of a cushioning mechanism.

FIG. 10 illustrates another embodiment of impact absorbing mechanism 140 that includes a plurality of flexible cantilevers 142. Cantilevers 142 include a support 144 attached to the inside surface of frame 24 and extends in a direction away from frame 24. Cantilevers 142 include an elongated flexible arm 146 that is attached at one end to support 144. Arm 146 extends toward front end 20 of frame 24. Arm 146 has an opposite end that is freely disposed from support 144 and frame 24. Cantilevers 142 also include a bumper 148 mounted on the free end of arm 146. Bumper 148 extends away from free end of arm 146 toward deck 40 in a direction that is substantially perpendicular to deck 140.

Impact absorbing mechanism 140 includes an elongated brace 150 that is configured to manually adjust the flexibility of cantilevers 142. Brace 150 is mounted to frame 24 adjacent to cantilevers 142. Brace 150 extends substantially perpendicular to the longitudinal axis of frame 24 and is configured to cooperate with frame 24 and to move parallel to the longitudinal axis of frame 24. As depicted in FIG. 10, frame 24 a has elongated slots 152 formed therein to accommodate movement of brace 150, which is selectively movable along the longitudinal axis of frame 24 and the length of cantilever 142 to change in the amount of cushioning provided by cantilevers 142 by increasing or decreasing the amount of deflection of arm 146 in response to a user operating on the exercise section 38 of belt 32. For example, if brace 150 is moved along the length of cantilevers 142 towards bumper 148 on arm 146, the amount of deflection or amount of cushioning is decreased. In contrast, if brace 150 is moved towards support 144, the amount of deflection will increase which consequently results in the amount of cushioning provided to the user increasing.

Various other configurations of brace 150 and slots 152 may perform the function thereof as long as brace 150 and slots 152 are configured to cooperate. Brace 150 and slots 152 in frame 24 are one example of structure capable of performing the function of a means for selectively adjusting the flexibility of cantilever 142.

Figure 11:
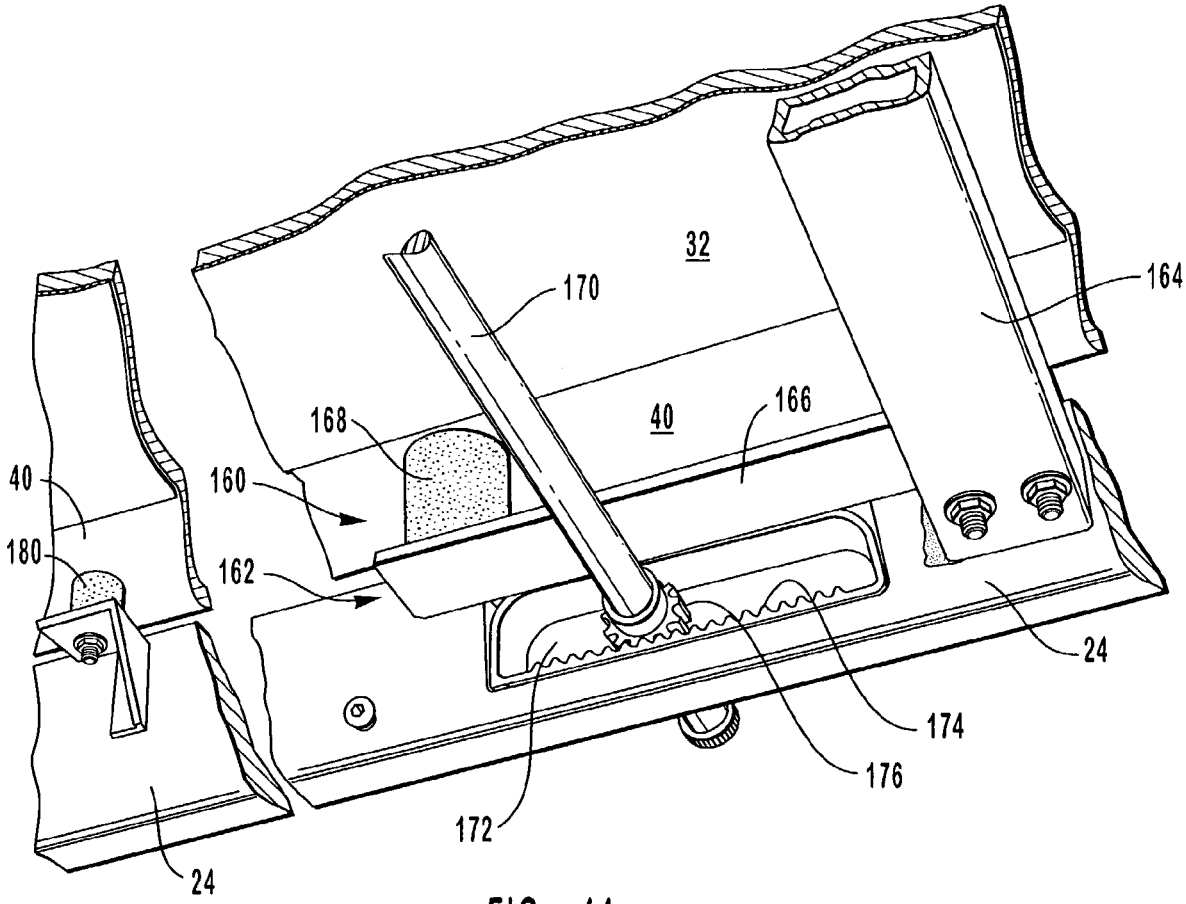
FIG. 11 is a partial cross-sectional perspective view of another exemplary embodiment of a cushioning mechanism.

FIG. 11 illustrates yet another embodiment of an impact absorbing mechanism 160 that includes a plurality of flexible cantilevers 162, only one of which is shown in FIG. 11. Cantilever 162 includes a support 164 attached to an inside surface of frame 24, such as a crossbeam. Cantilever 162 further includes an elongated arm 166, such as, but not limited to, steel or other metal arm that is attached at one end to support 164. Arm 166 extends toward front end 20 of frame 24. Arm 166 has an opposite end that is freely disposed from support 164 and frame 24.

Cantilever 162 also includes a bumper 168 mounted on the free end of arm 166. Bumper 168 extends away from the free end of arm 166 toward deck 40 in a direction that is substantially perpendicular to deck 40. As another example of a cantilever, another elongated arm and a bumper attached thereto (not shown) extends from an a opposing end of support 164 in parallel relationship to cantilever 162 shown in FIG. 11. In one embodiment, bumper 168 is positioned toward the front end 20 of base 12, e.g., within the front one-third of base 12.

Impact absorbing mechanism 160 further includes an elongated brace 170 that is configured to manually adjust the flexibility of cantilevers 162. Brace 170 is mounted to frame 24 adjacent to cantilevers 162. Brace 170 extends substantially perpendicular to the longitudinal axis of frame 24 and is configured to cooperate with frame 24 and to move parallel to the longitudinal axis of frame 24.

As depicted in FIG. 11, frame 24 has elongated slots 172 formed therein to accommodate movement of brace 170. A second slot is not shown in FIG. 11, but is preferably on an opposing side of frame 24 from slot 172 for receiving an opposing end of brace 170 from that shown in FIG. 11. Brace 170 is selectively movable along the longitudinal axis of frame 24 within opposing slots 172 and along the length of opposing cantilevers 162 to change the amount of cushioning provided by cantilevers 162 by increasing or decreasing the amount of deflection of arms 166 in response to a user operating on the exercise section 38 of belt 32. For example, if brace 170 is moved along the length of cantilever 162 towards bumper 168 on arm 166, the amount of deflection or amount of cushioning is decreased. In contrast, if brace 170 is moved towards support 164, the amount-of deflection will increase which consequently results in the amount of cushioning provided to the user increasing.

Also as shown in FIG. 11, in one embodiment, each of the opposing slots 172 have teeth 174 therein for selectively receiving gears 176 coupled to opposing ends of brace 170. Teeth 174 and gears 176 allow convenient adjustment of brace 170 within slots 172 and assist in maintaining brace 170 in a desired orientation within slots 172 during an exercise routine. By moving brace 170 forward and backward within opposing slots 172, each of the opposing cantilevers 162 is adjusted, preferably achieving an equal degree of deflection.

Various other configurations of brace 170 and slots 172 may perform the desired function as long as brace 170 and slots 172 are configured to cooperate. Brace 170 and slots 172 in frame 24 are one example of structure capable of performing the function of a means for selectively adjusting the flexibility of one or more cantilevers.

As mentioned above, in one embodiment, front end 20 of deck 40 is not secured to frame 24. Instead, back end 22 of deck 40 is secured to frame 24 (through the use of screws, for example), while front end 20 moves freely from frame 24, enhancing the ability to adjust the amount of cushioning applied to front end 20 of deck 40.

In one such embodiment, at least one and preferably both sides of front end 20 of deck 40 also rest on a cushioned isolator 180, shown in FIG. 11, without being coupled to the isolator 180. However, in another embodiment, front end 20 and back end 22 of deck 40 are both coupled to frame 24 by screws, for example. The screws may be disposed through the deck, the frame, and an isolator, such as isolator 180 disposed between the frame and the deck, for example.

Figure 12:
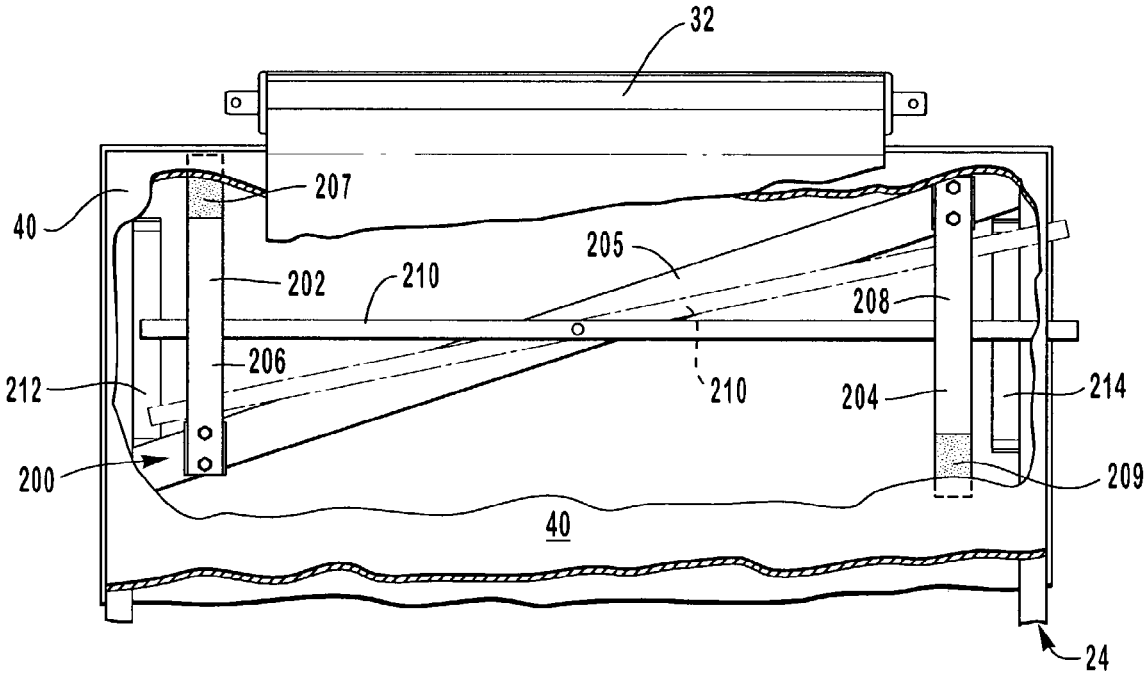
FIG. 12 is a partial cut-away top elevation view of another exemplary embodiment of a cushioning mechanism.

Another example of an impact absorbing mechanism 200 that includes a plurality of flexible cantilevers 202, 204 is shown in FIG. 12. Cantilevers 202, 204 include a support 205 attached to frame 24 diagonally with respect to the longitudinal axis of frame 24. Cantilevers 202, 204 further include respective elongated arms 206, 208 attached to opposing ends of diagonal support 205. Bumpers 207, 209 are coupled to free ends of respective arms 206, 208 below deck 40. Bumpers 207, 209 extend upwardly with respect to respective arms 206, 208 and intersect deck 40. As shown, bumpers 207, 209 and arms 206, 208 of respective cantilevers 202, 204 are oriented in opposing directions.

Impact absorbing mechanism 200 further includes an elongated brace 210 that is configured to manually adjust the flexibility of cantilevers 202, 204. Brace 210 is mounted to frame 24 by being pivotally coupled to support 205. Brace 210 has opposing ends that are disposed beneath respective arms 206, 208. Frame 24 has elongated slots 212, 214 formed therein on opposing sides to accommodate pivotal movement of the ends of brace 210. Brace 210 moves along the length of opposing cantilevers 202, 204 to change the amount of cushioning provided by cantilevers 202, 204 by increasing or decreasing the amount of deflection of arms 202, 204. One advantage of mechanism 200 is that the amount of cushioning provided is adjustable by pivoting brace 210 in a desired direction.

Brace 210 and slots 212, 214 in frame 24 are one example of structure capable of performing the function of means for selectively adjusting the flexibility of one or more cantilevers.

It may be appreciated by those skilled in the art that although the various embodiments illustrated in the figures usually have two (2) cushioning members or two (2) cantilevers, any other number of one or more cushioning members or cantilevers may be used in treadmill 10.

Although not shown in the figures, it is contemplated that treadmill 10 (FIG. 1) includes means for supplying power to exercise base 12 to drive continuous belt 32. The means for supplying power to base frame 12 is disposed in front end 20 of exercise base 12. One embodiment of structure capable of performing the function of such a means includes a motor that rotates a first pulley and drives a belt. The belt drives a second pulley that is connected to front roller 34 about which belt 32 is disposed. As previously stated, the rear portion of belt 32 is also disposed around rear roller 36. Other embodiments capable of performing the function of such a means may include a flywheel. The flywheel is connected to belt 32 and receives energy from the user operating on belt 32 of exercise base 12. The flywheel also delivers energy to belt 32 as the user performs walking, running or jogging exercises when a user is not in contact with belt 32.

FIGS. 13-16B depict an alternate treadmill 310 with another embodiment of an impact absorbing mechanism 300 that is configured for selective adjustment to provide selectable amounts of impact cushioning when a user is operating on an exercise section of a belt.

Figure 13:
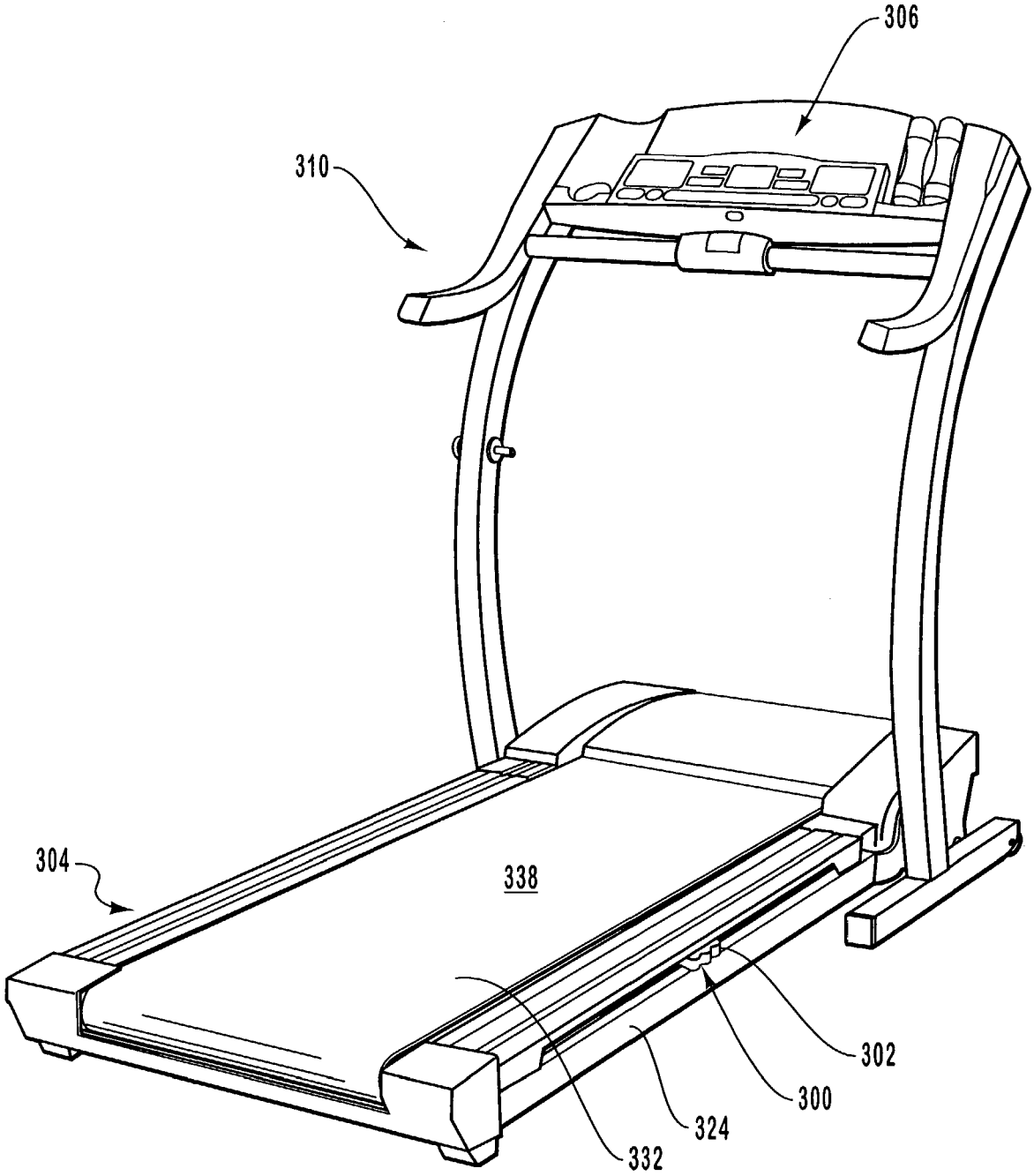
FIG. 13 is a perspective view of a treadmill having another exemplary embodiment of a cushioning mechanism.

Treadmill 310 includes an exercise base 304 including: (i) a frame 324, which may be the same or similar to the frame 24 of FIGS. 1 and 7; (ii) an endless belt 332 trained about front and rear rollers coupled between opposing ends of right and left frame members 325, 326 (FIG. 15), such as discussed regarding belt 38 of FIGS. 1 and 7; (iii) a deck 340 (FIGS. 14-15) coupled to frame 324, such as discussed regarding deck 40 of FIGS. 1 and 7; and (iv) an impact absorbing mechanism 300 at least partially disposed between deck 340 and frame 324. A support structure 306 is coupled to base 304 (e.g., rotatably coupled to the base 304 such that the base 304 may be selectively oriented in an operational position, as shown in FIG. 13, or an upright storage position).

Impact absorbing mechanism 300, which is another example of an impact absorbing means, includes first and second cushioning members 302 (FIGS. 14-15) on opposing sides of treadmill 310. Cushioning members 302 are optionally substantially parallel to deck 340 and are at least partially disposed between deck 340 and frame 324. While cushioning members 302 may be movably attached to either deck 340 or frame 324, in the embodiment of FIG. 14 cushioning members 302 are rotatably attached to deck 340 by a vertical axle 308, such that frame 324 of treadmill is contacted by downwardly extending cushioning members 302.

Member 302 has a plurality of portions, each of which have different cushioning properties, as will be discussed in detail below. To adjust the degree of cushioning, the user causes at least one and preferably both cushioning members 302 to rotate horizontally such that the desired cushioning portion is positioned between the treadmill deck 340 and frame 324.

As shown in FIGS. 14-16B, cushioning members 302 each include a base 312 with a plurality of arms 302*a*-302*c* projecting therefrom. Arms 302*a*-302*c*, each have different cushioning properties. Thus, cushioning members 302 each have a plurality of cushioning portions, namely arms 302*a*-302*c*, each having different cushioning properties. Members 302 each have a generally triangular shape. However, it is intended that the cushioning members that rotate horizontally to adjust the degree of cushioning may have various other shapes without affecting the function thereof, such as square, rectangular, polygonal, oval, propeller-shaped, or various other configurations.

In order to selectively lock a desired arm 302*a*-302*c* into a desired position, a spring loaded ball detent 318 (FIG. 14) engages one of three recessed areas 320*a*-302*c* (FIG. 15) on the top surface of cushioning member 302, depending upon the degree of cushioning selected by the user. The recessed areas 320*a*-320*c* are positioned so as to selectively engage the detent 318 and thereby hold the desired respective arm 302*a*-302*c* in place between deck 340 and frame 324. The same result may be achieved by placing a detent in cushioning member 302 which could engage one of a number of different recessed areas in deck 340 or frame 324. Alternatively, the detent may be molded as part of cushioning member 302.

Differing degrees of cushioning may be achieved in cushioning members 302 by (i) providing cushioning portions of differing materials; (ii) providing cushioning portions having differing levels of flexibility; (iii) providing cushioning portions having different sizes and/or (iv) providing cushioning portions that are hollower than others, for example. Thus, a variety of different methods of manufacture may be employed to form each member 302.

In the embodiment of FIGS. 14-16B, each member 302 is formed by forming a frame 314 configured to hold a plurality of cushioning pads 316*a*-316*c* therein. Each arm portion

302*a*-302*c* includes (i) a respective frame portion 317*a*-317*c*; and (ii) a respective pad 31.6*a*-316*c* coupled to a respective frame portion 317*a*-317*c*.

In the embodiment of FIGS. 13-16B, frame 314 includes a rigid or semi-rigid material, while cushioning pads 316*a*-316*c* each include a more flexible material that is coupled onto frame 314, such as, but not limited to, through molding. Thus, frame 314 may include a material that is more rigid than pads 316*a*-*c* for example. In one embodiment, frame 314 is molded, after which pads 316*a*-316*c* are molded thereon. By way of example, the frame and/or pad portions of cushioning members 302 may be formed from SANTOPRENE, polyvinyl chloride (PVC), thermoplastic elastomer, foam and/or other suitable material. For example, in one embodiment the frame 314 and pads 316*a*-*c* each include a SANTOPRENE material, but have different degrees of flexibility.

Figure 14:
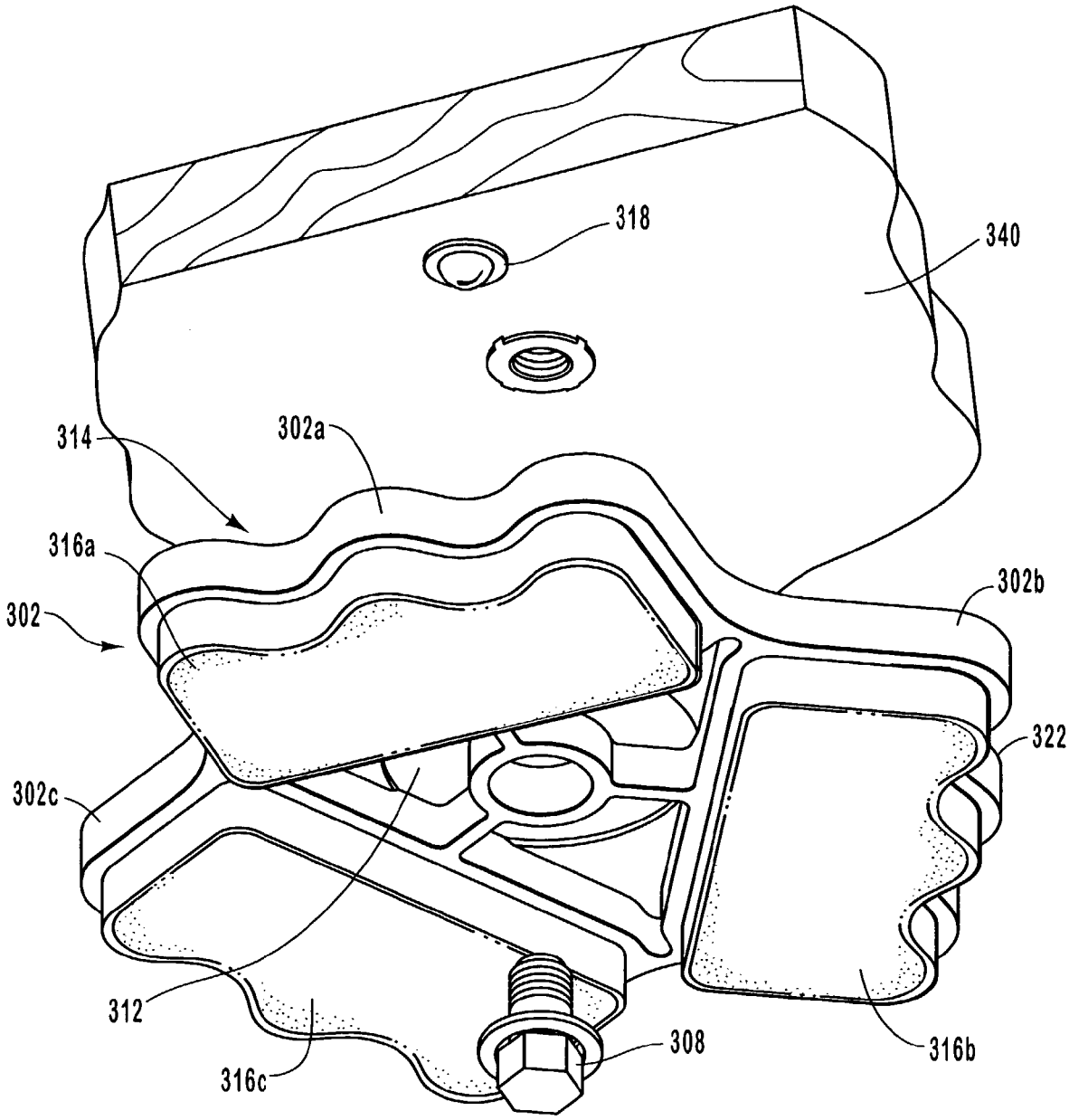
FIG. 14 is a bottom view of a cushioning member of the treadmill featured in FIG. 13 shown adjacent a deck illustrated in a cutaway, exploded view.
Figure 16A:
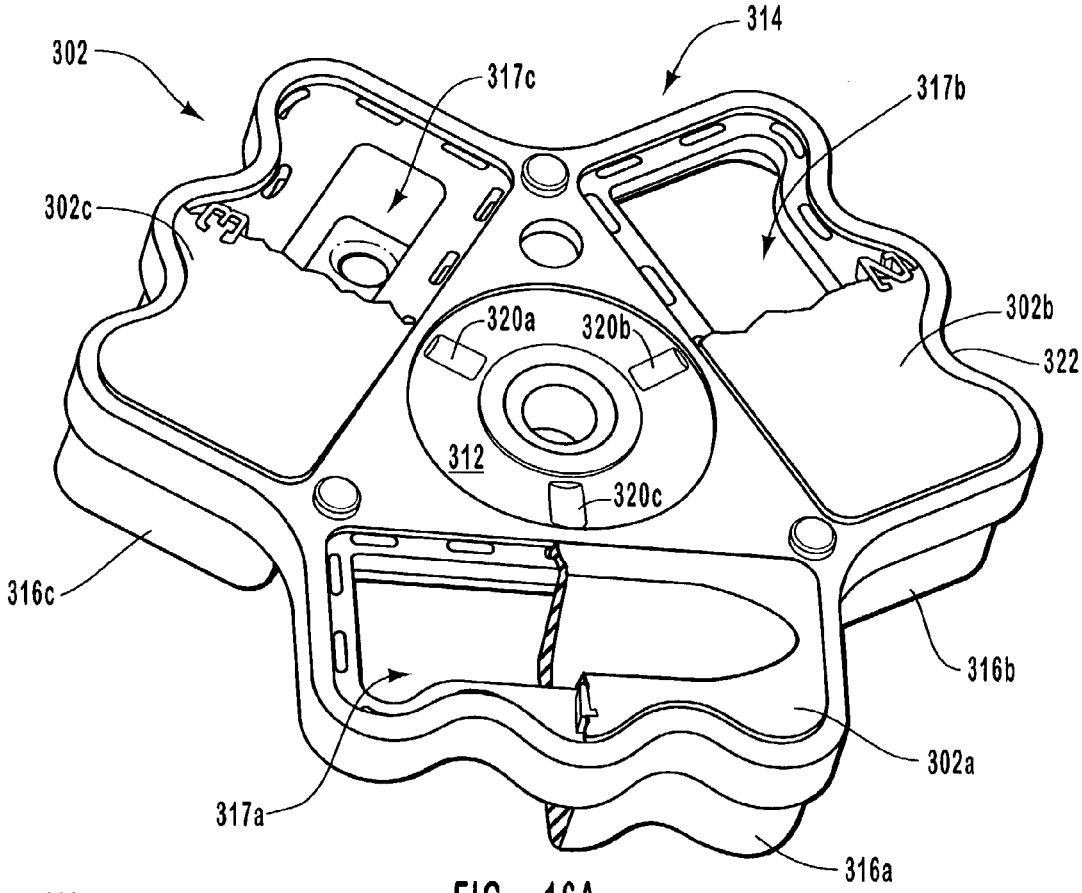
FIG. 16*a* is a top view of a cushioning member frame with cushioning pads shown in a cutaway view mounted therein.

Frame 314 is configured to receive different pads therein, the pads being shown in a bottom view in FIG. 14, and in a cutaway top view in FIG. 16A. A bottom view of the frame is shown without the pads in FIG. 16B.

Figure 16B:
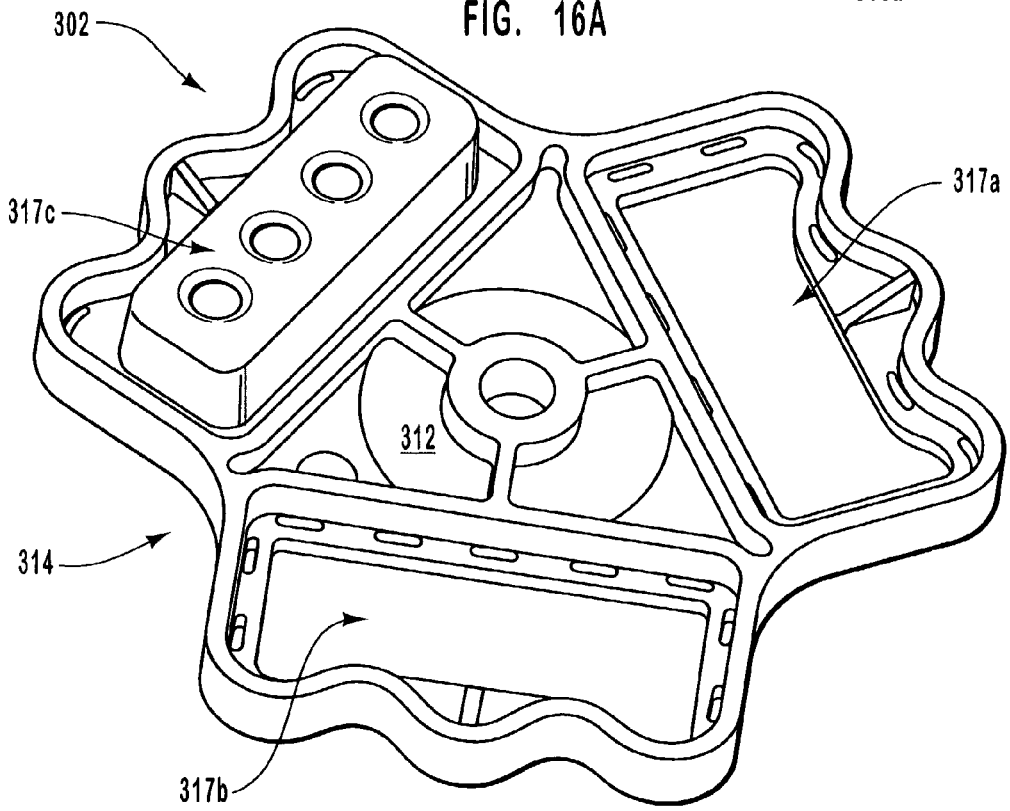
FIG. 16*b* is a bottom view of the cushioning member frame of FIG. 17*a* without the pads shown therein.

In the embodiment of FIGS. 16A-B, cushioning frame 314 includes a first frame portion 317*a*, a second frame portion 317*b*, and a third frame portion 317*c*. First and second frame portions 317*a*-317*b* essentially have large apertures therethrough, such that a significant amount of space is available for corresponding pad material 316*a*-316*b*. Third frame portion 317*c* includes more frame material and has less space therein for the corresponding pad material 316*c*.

Since arm 302*c* includes a substantial amount of rigid or semi-rigid frame material 317*c* and a reduced amount of flexible pad material 316*c*, arm 302*c* is more rigid than arms 302*a* and 302*b*. The pad material 316*a* of arm 302*a* has a large groove therein, whereas the pad material 316*b* of arm 302*b* is solid. Thus, arm 302*a* is more flexible than arm 302*b*.

In summary, arm 302*c* includes less pad material 316*c* and more frame material 317*c* than arm 302*b*, and is consequently more rigid than arm 302*b*. Arm 302*a* has a pad 316*a* having a substantial groove therein, and is consequently more flexible than arm 302*b*. Thus, arm 302*c* is more rigid than arm 302*b*, which is more rigid than arm 302*a*. In light of the different properties of the respective arms, a user desiring different cushioning properties for treadmill 310 may select a desired level of cushioning.

Nevertheless, although arms 302*a*-302*c* of cushioning members 302 are depicted as having raised pad portions formed thereon that have different internal configurations, other embodiments of cushioning members perform the function thereof, such as by employing pad portions having different sizes or different densities. In addition, instead of cushioning members 302 being pivotally mounted below deck 340, cushioning members 302 may be movably attached to frame 324 by vertical axles.

Indicia, such as the numbers 1, 2, and 3 (or other indicia, such as lettering, color coding, providing other symbols, etc.) may be provided on the frame and/or pads of member 302 to allow a user to visually determine which amount of cushioning has been selected. For example, in the embodiment of FIG. 16A, the numeral "1" corresponds to the most flexible amount of cushioning (arm 302*a*), the numeral "2" corresponds to an intermediate amount of flexibility (arm 302*b*), and the numeral "3" corresponds to the most rigid amount of cushioning (arm 302*c*).

Figure 15:
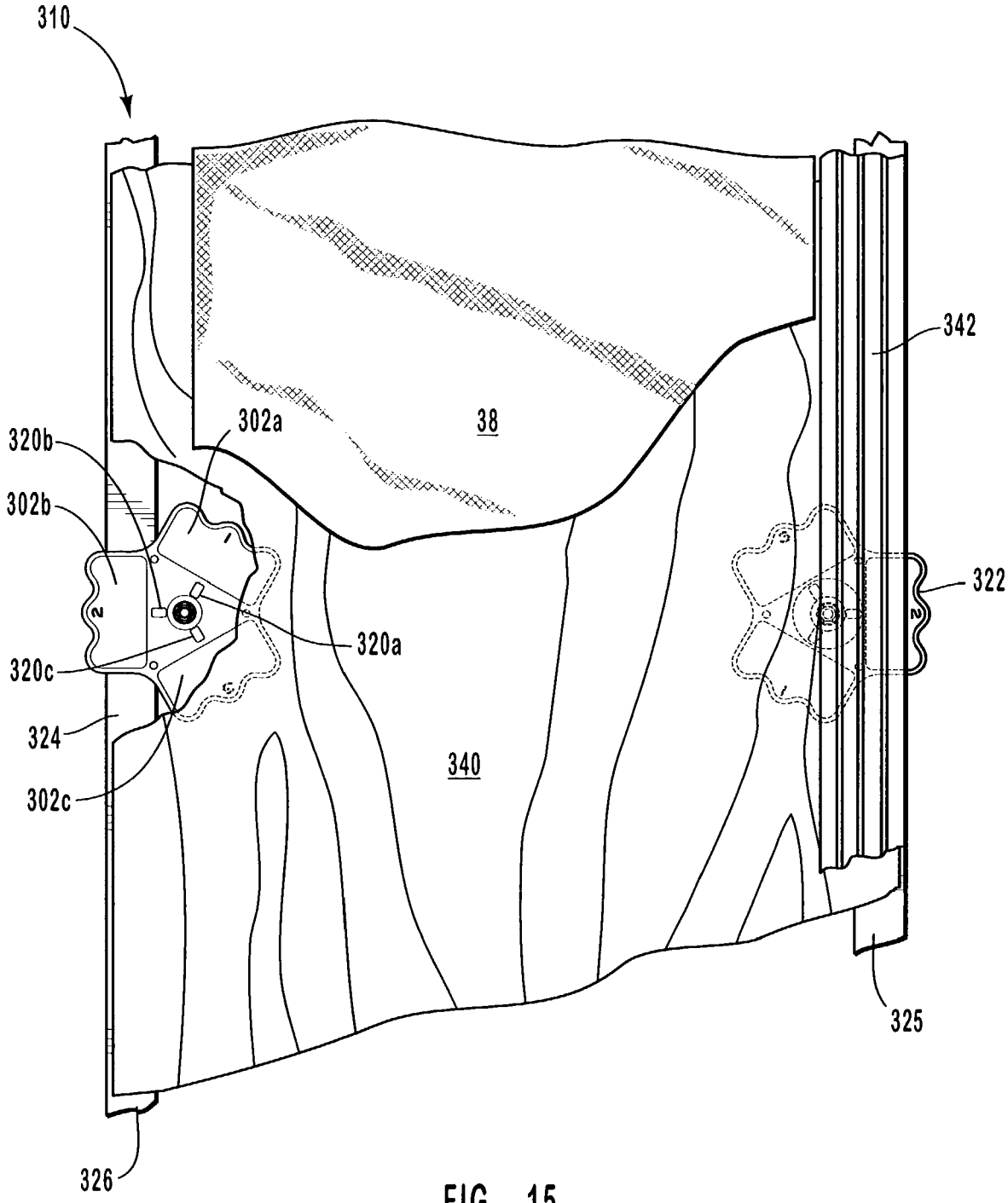
FIG. 15 is a cutaway top view of the treadmill of FIG. 13 with first and second cushioning members of the cushioning mechanism shown partially in phantom views.

Thus, as shown in the embodiment of FIG. 15, a user desiring an intermediate level of cushioning may move cushioning members 302 until the number 2 or other indicia appears on the edge of the treadmill of FIG. 15. In this embodiment, arms 302*b* of members 302 are mounted between frame 324 and deck 340 to thereby provide an intermediate level of flexibility to treadmill 310.

Gripping grooves 322 on members 302, as depicted in FIG. 16A, allow a user to conveniently grip member 302. Thus, members 302 may be selectively adjusted according to the desired amount of cushioning by gripping the gripping grooves 322 and rotating member 302 in a horizontal plane. Such grooves 322 are one embodiment of structure capable of performing the function of a means for selectively adjusting cushioning members 302 to provide differing amounts of impact cushioning. Various other embodiments of structure capable of performing the function of such a means for selectively adjusting members 302 may be employed.

Impact absorbing mechanism 300 may further include a linkage or a cable (not shown), (e.g., similar to element 106 shown in FIG. 7), configured to mechanically interconnect cushioning members 302 such that movement of one cushioning member 302 results in corresponding movement of other cushioning members 302. Various embodiments of structure capable of performing the function of such means for mechanically interconnecting cushioning members 302 are known to those skilled in the art, including, but not limited to, those disclosed above with respect to other embodiments of cushioning members. For example, each cushioning member 302 may be configured with a gear thereon. A chain may link the gears such that movement of one of cushioning members 302 results in corresponding movement of other cushioning members 302.

As shown in FIG. 15, frame 324 includes right and left frame members 325, 326, such as discussed with reference to base 12 of FIG. 1. Front and back rollers are attached laterally between respective front and back ends of frame members 325, 326 and an endless belt 332 is trained over the front and back rollers. A right side rail 342 is shown mounted on deck 340. Optionally, a left side rail may also be mounted on deck 340.

Deck 340 may be mounted on frame 324 in a variety of different manners, such as those discussed above with regard to deck 40 and frame 24. In one embodiment, the rear portion of the deck is immovably affixed to rear portions of opposing frame members 325, 326 while the front portion of the deck 340 is coupled to the front portions of opposing frame members 325, 326 through the use of elastomeric isolators coupled between the deck and the frame that allow some deflection between the deck 340 and the frame 324 during use. In another configuration, both the rear portion and the front portion of the deck are coupled to opposing frame members 325, 326 through use of elastomeric isolates. In still another configuration, the front portion of deck 340 is affixed to the front portion of opposing frame members 325, and 326.

Figure 17:
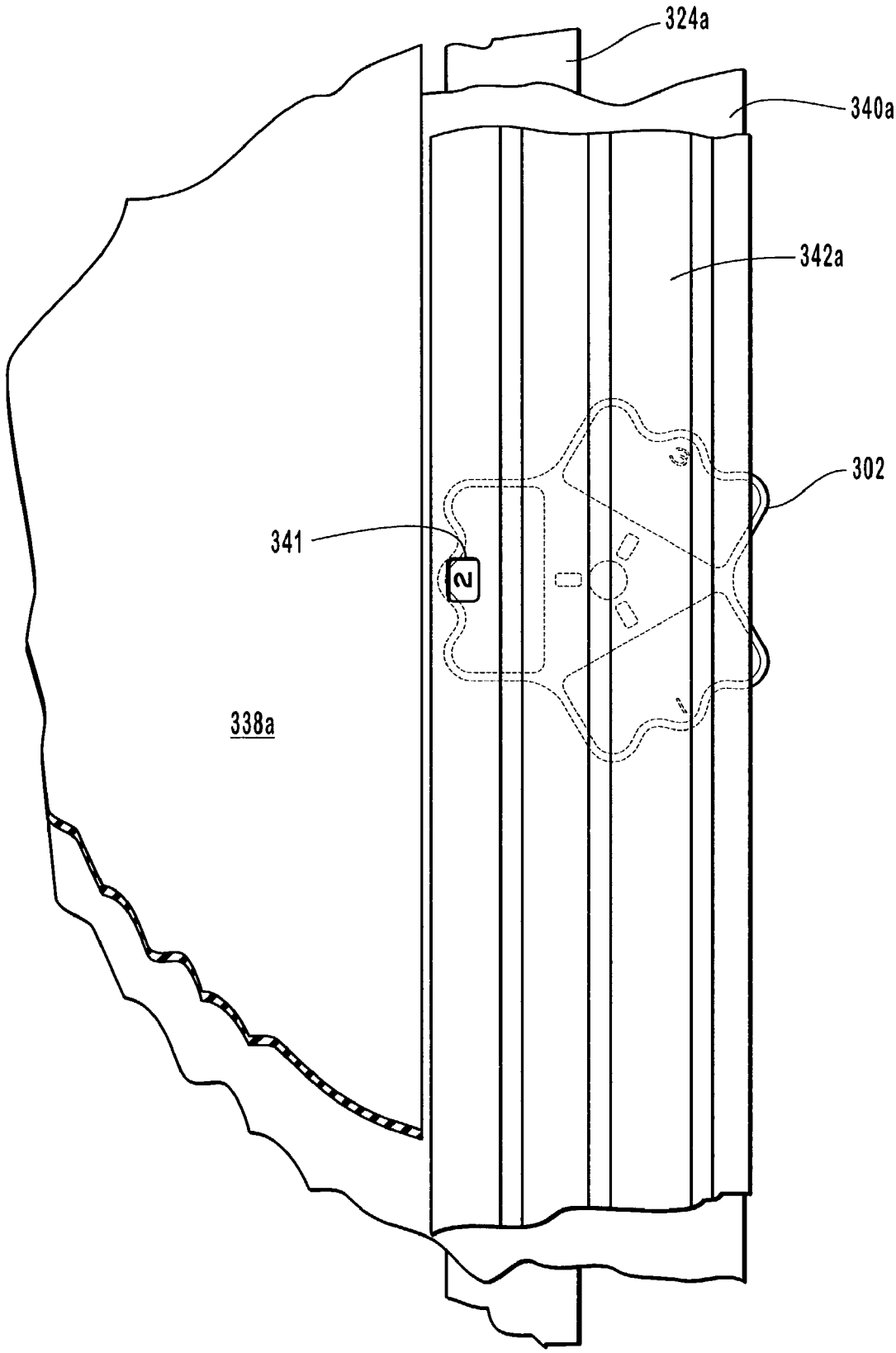
FIG. 17 is a cutaway top view of an alternate treadmill having the cushioning mechanism of FIG. 14 therein (shown partially in phantom lines) and having an aperture through the deck and side rail to thereby view a selected cushioning setting.

FIG. 17 provides a view of an alternate treadmill embodiment of the present invention, wherein first and second frame members 324*a* (only one frame member shown) are positioned below deck 340*a* in such as manner that the frame members 324*a* are inwardly disposed with respect to the sides of deck 340*a*. In this embodiment, the indicia (e.g., the numeral "2") on the cushioning member 302 is viewed by a user through the use of an aperture 341 through deck 340*a* through which the user may view the numeral. A corresponding aperture 341 also exists in the side deck rails 342*a*, which are mounted on the sides of deck 340*a* adjacent treadmill belt 338*a*. Thus, in one embodiment, deck 340*a* and side deck rail 342*a* of the present invention each have an aperture 341 therethrough such that the user may see through deck 340*a* and rail 342*a* to view the indicia (e.g., the numeral "2") on respective members 302 on opposing sides of the deck 340*a*. One or both sides of deck 340*a* and one or both corresponding deck rails may have an aperture 341 therethrough corresponding to one or more respective cushioning members 302.

Figure 18:
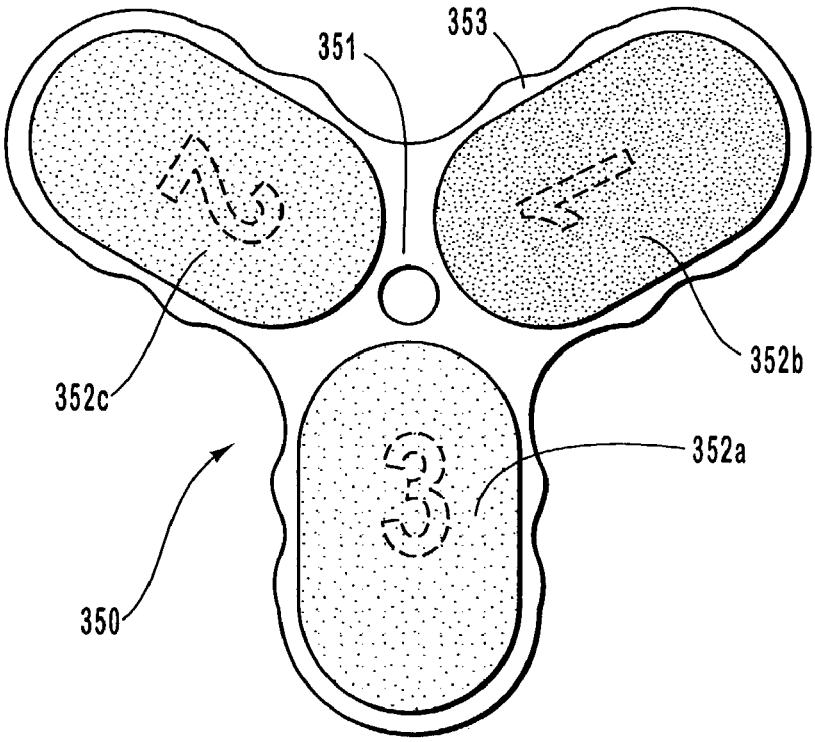
FIG. 18 is a bottom view of an alternate cushioning member with numbers indicating different cushioning portions shown in phantom lines.

FIG. 18 provides a top view of an alternate cushioning member 350 of FIG. 17. As illustrated, the cushioning member 350 includes a base 351 having a plurality of arms 352*a*-352*c* radially extending therefrom. Each of the cushioning arms 352*a*-352*c* has different cushioning properties to allow a user to selectively adjust the amount of cushioning provided. The difference in cushioning may be achieved using material having different densities, different configurations, different sizes, by hollowing on or more portions, or using stiffer materials surrounded by different amounts of padded material, for example. In one embodiment, arm 352*b* is denser, and consequently more stiff, than arm 352*a* and less dense and stiff than arm 352*c*. In yet another embodiment, the pad on an intermediate level cushioning arm is larger than the least cushioned arm and smaller than the most cushioned arm. In yet another embodiment, an arm having a hollow or grooved pad, an arm having a solid pad, and an arm comprising more frame material than the other arms, as discussed with reference to member 302, are employed. Indicia, e.g., numerals corresponding to the differences in flexibility are shown in phantom lines. These indicia appear on the top portions of arms 352*a*-352*c*.

Thus, an example of another cushioning mechanism of the present invention includes first and second cushioning members, configured such as member 350, on opposing sides of a treadmill between the deck and the frame thereof. However, optionally member 350 may be employed on a single side to form a cushioning mechanism.

Figure 19:
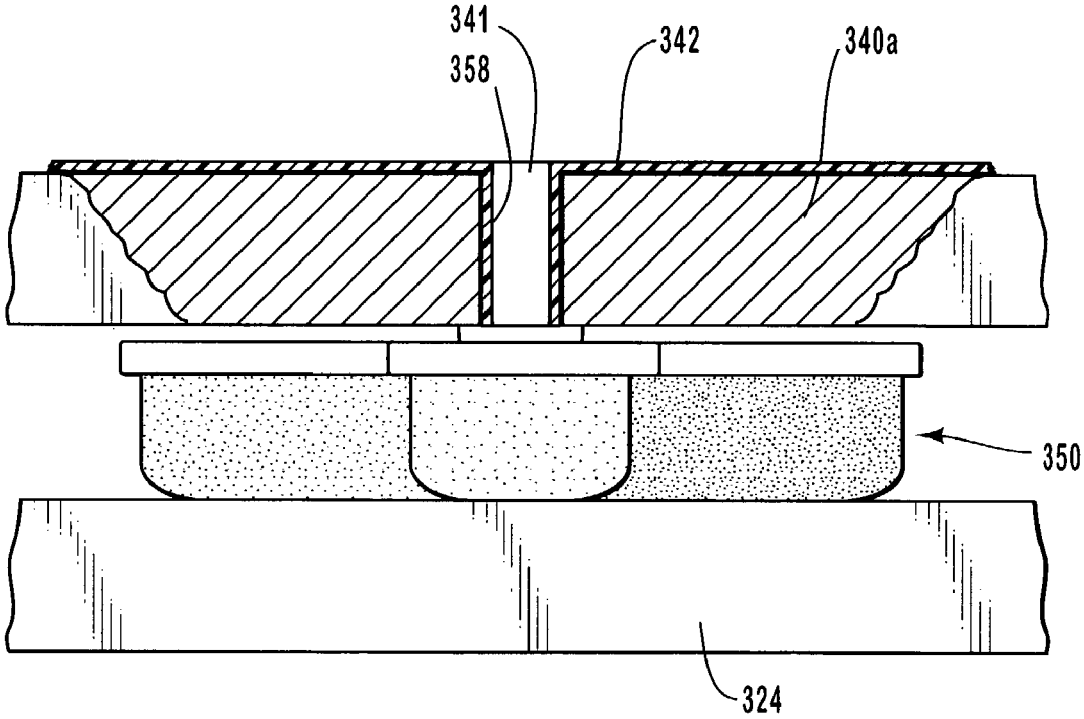
FIG. 19 is a partially cutaway side view of an alternate treadmill having an aperture through the treadmill side rail and deck to thereby allow viewing of the number shown in phantom view in FIG. 18.

As illustrated in FIG. 19, cushioning member 350 is coupled between frame 324*a* and deck 340*a*, such as with a vertical axle. Deck rail 342 is also shown. In the embodiment of FIG. 19, deck rail 342 and deck 340*a* each have an aperture 341 therethrough that allows the user to visually inspect the corresponding indicia, e.g., numeral, to thereby determine the amount of cushioning selected by the user. The deck rail 342 of FIG. 19 has an integral tubular sleeve 358 that fits downwardly within the aperture in deck 340*a* to thereby enhance the aesthetic appearance of the aperture in deck 340*a*. By viewing through sleeve 358, the user may see what level of cushioning has been selected. Optionally, a glass or plastic window may be placed in the aperture in the deck and/or rail. The deck rail(s) 342*a* discussed with respect to FIG. 17 may optionally employ sleeve 358 shown in FIG. 19.

Thus, in order to view the indicia indicating the level of cushioning employed, the cushioning portions with the indicia thereon may extend out from the area directly between deck and the frame such that the indicia is visible to the user, or an aperture through the deck may be employed. Each of these approaches is an example of a means for enabling a user to view the level of cushioning employed.

Figure 20:
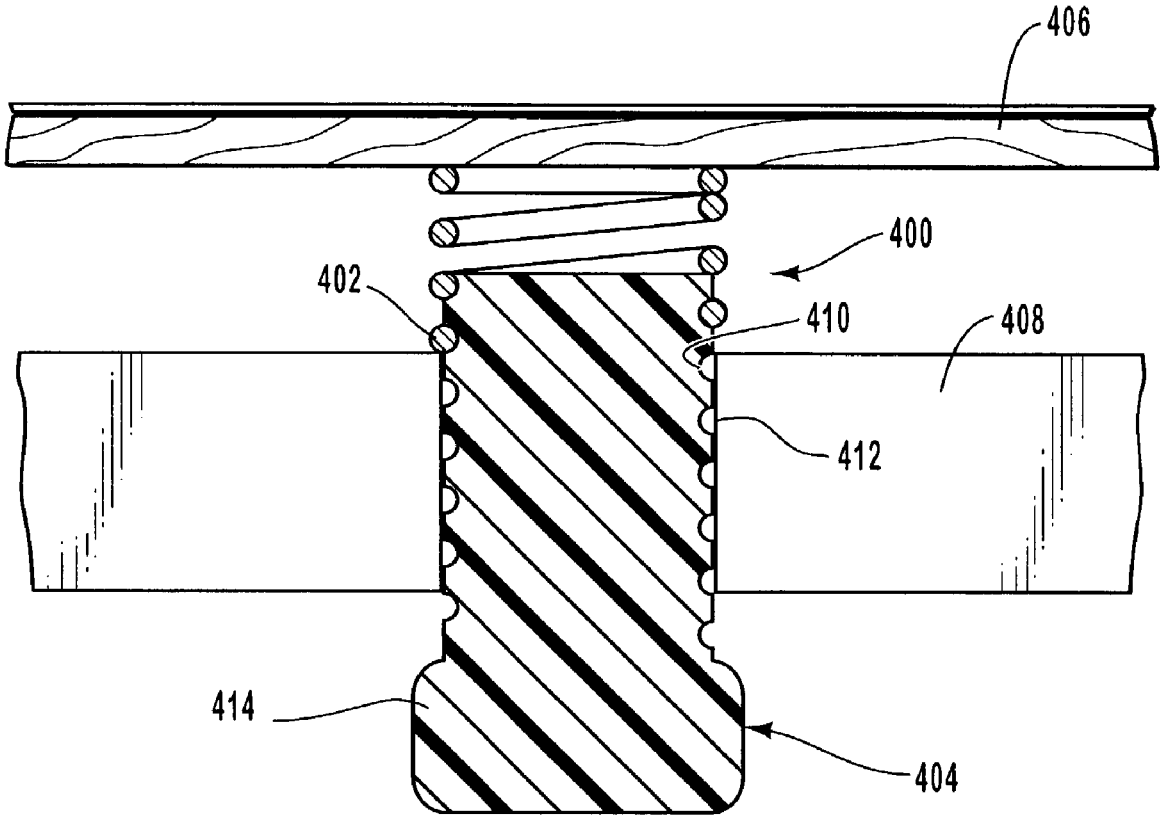
FIG. 20 illustrates another exemplary embodiment of a cushioning mechanism comprising a spring and a screw selectively mounted therein. The screw is shown in a cross sectional view.

FIG. 20 depicts an alternate embodiment of an adjustable cushioning mechanism 400 for use in an exercise device, such as a treadmill. Cushioning mechanism 400 includes a spring 402 and a screw 404 threadably mounted within spring 402. Spring 402 is coupled between treadmill deck 406 and treadmill frame 408. An aperture 412 extends through frame 408 (or optionally, in another embodiment, through the deck) and receives screw 404 therethrough. The interior of spring 402 is configured to correspond to threads 410 of screw 404 and to allow screw 404 to be threaded therethrough in a helical fashion.

As screw 404 extends into spring 402, the amount of cushioning is adjusted. The extension into or extraction from spring 402, respectively, decreases or increases the ability of spring 402 to cushion. In other words, the movement of screw 404 with respect to spring 402 selectively increases or decreases the effective length of spring 402.

Thus, as screw 404 is threaded out of spring 402, the effective length of spring 402 is increased and the degree of flexibility increases; and as screw 404 is threaded into spring 402, the effective length of spring 402 is decreased and the degree of flexibility decreases.

In the embodiment of FIG. 20, treadmill frame 408 is raised off the support surface sufficiently enough that the user may place his/her hand under frame 408, grip a knob 414 of screw 404, and selectively thread screw 404 into spring 402 or out of spring 402 to thereby adjust the amount of flexibility achieved. The space between the support surface and knob 414 allows the user to rotate knob 414. Alternatively, screw 404 is coupled to an adjustment mechanism that includes a motor to selectively adjust the cushioning by threading the screw.

Spring 402 may be coupled between deck 406 and frame 408 in a variety of different manners. For example, in one embodiment, the ends of the deck and the frame are coupled together in such a manner as to maintain spring 402 therebetween. In another embodiment, one or both ends of the spring are embedded into a corresponding deck or frame portion. For example, one end (e.g., the top end) of the spring may be embedded in the deck or frame while the opposing portion of the spring is not embedded but rests against the opposing frame or deck portion. In another embodiment, a screw extends from the deck or frame (or both) and connects with the corresponding end (e.g., the top end) of the spring. In yet another embodiment, the opposing ends of the spring are captured within cups (i.e., surrounded by the rims of the cups) mounted on respective portions of the deck and frame. One or both cups may have an aperture therethrough in order to allow the screw to extend therethrough.

In another embodiment, frame 408 is internally threaded so as to threadably receive screw 404 therein. In this embodiment, screw 404 is threadably received within frame 408 and spring 402. By way of example, screw 404 may include an elastomeric, plastic, synthetic, or similar material, although a variety of different materials may be employed.

Figure 21:
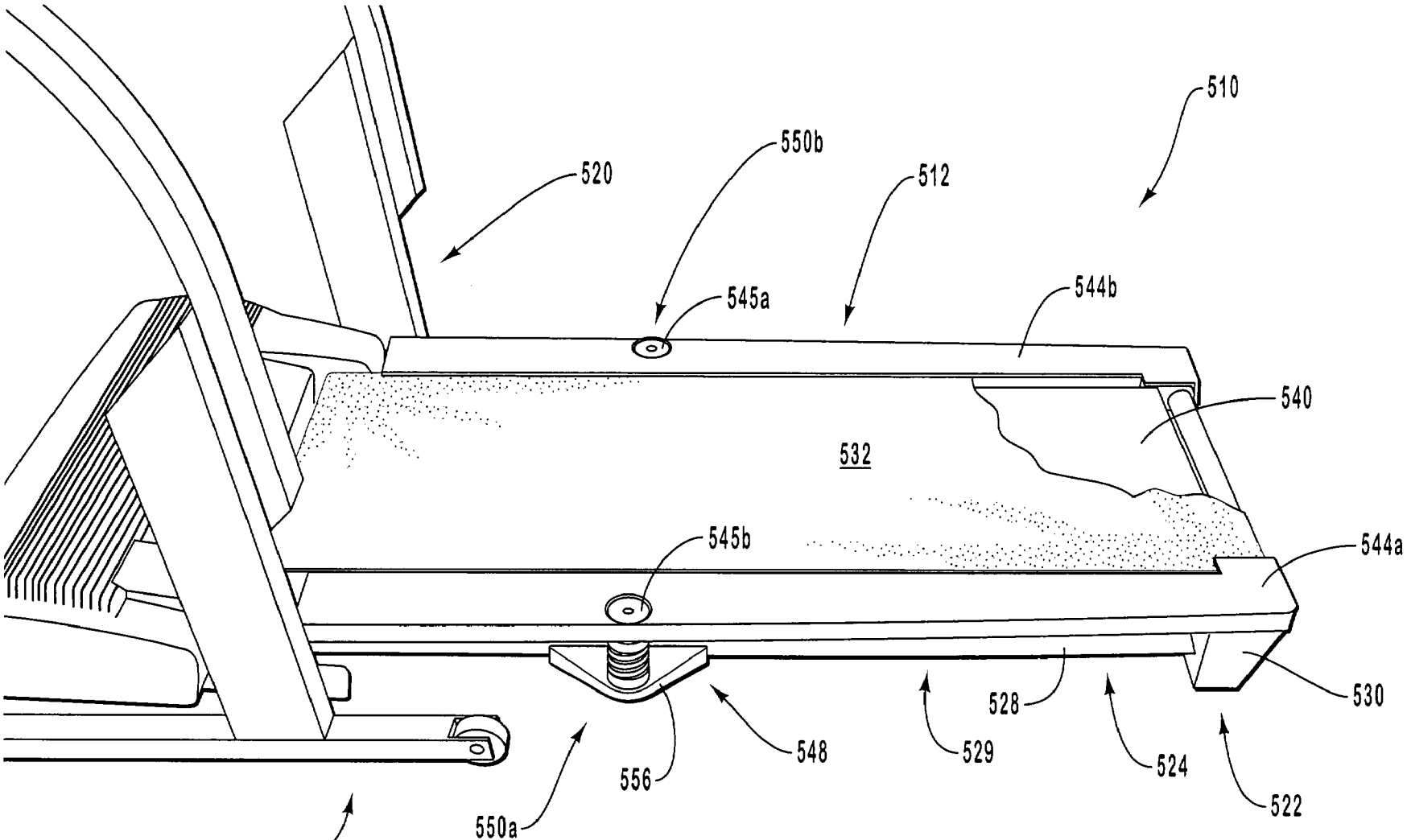
FIG. 21 illustrates another exemplary embodiment of a treadmill having a cushioning mechanism according to the present invention.
Figure 22:
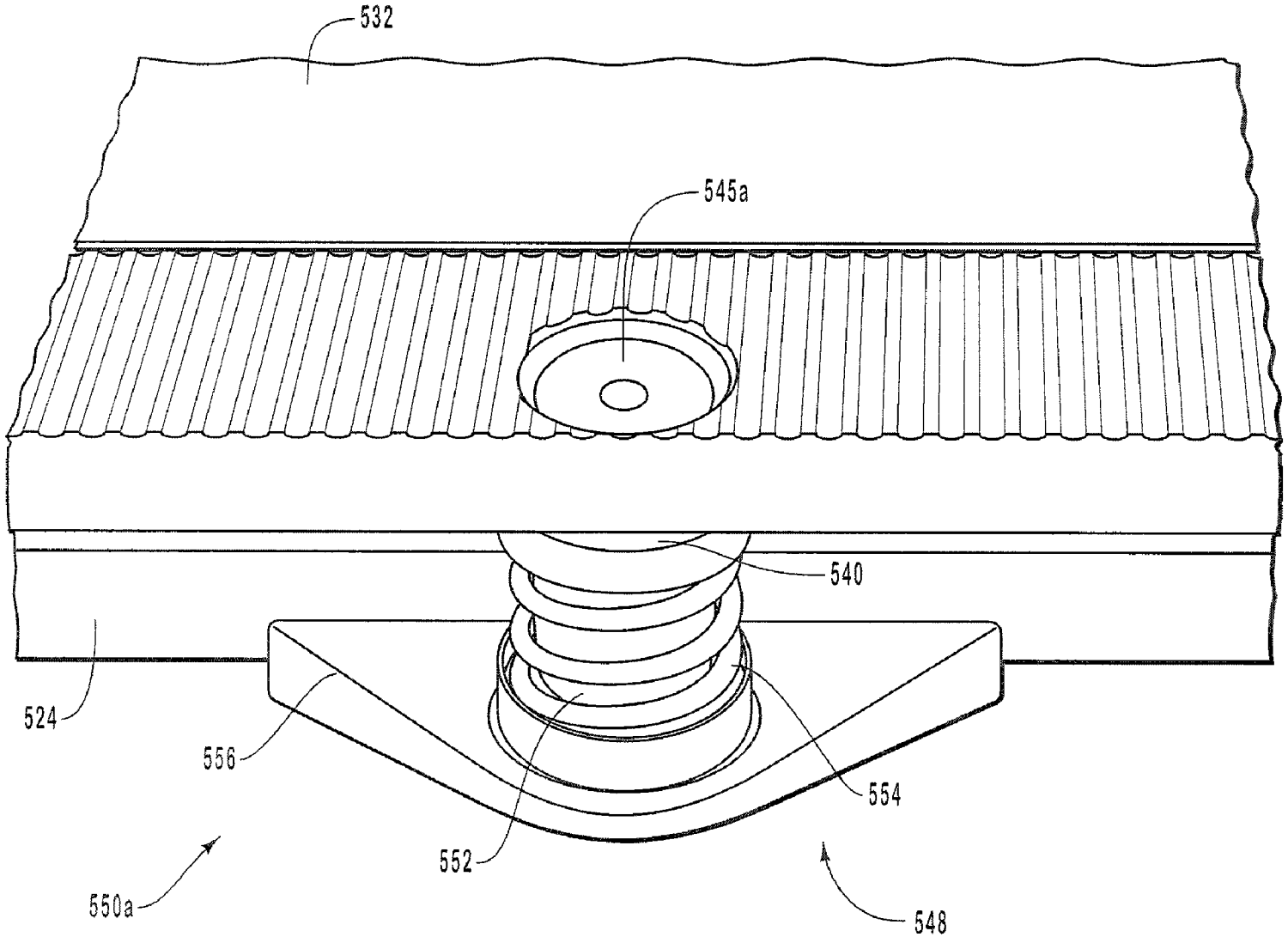
FIG. 22 illustrates a perspective close up view of a cushioning mechanism of FIG. 21.
Figure 23:
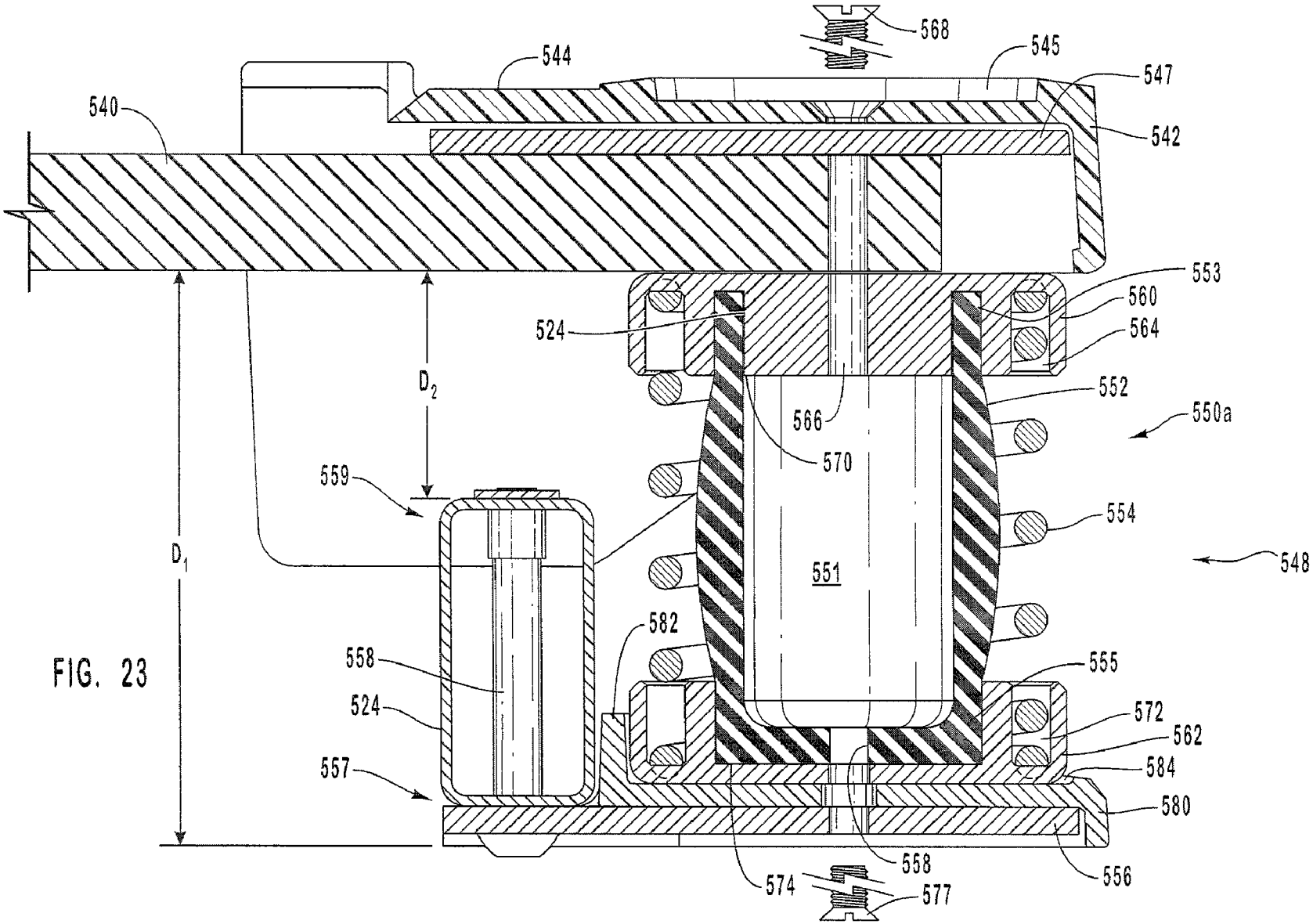
FIG. 23 illustrates a cutaway view of the cushioning mechanism featured in FIG. 22.

FIGS. 21-23 depict another embodiment of the present invention. An exercise device 510, such as a treadmill, includes an exercise base 512 and a support structure 514, in a similar manner to treadmill 10 of FIG. 1. The exercise base 512 includes a front end 520 and a back end 522. Front end 520 of exercise base 512 is attached to support structure 514. In one embodiment, base 512 is rotatably attached to support structure 514 such that base 512 can be readily folded into a storage position. However, optionally exercise base 512 may be fixably attached to support structure 514.

Exercise base 512 additionally includes a frame 524 that has a left frame member 528 and a right frame member (not shown), however, only the left side of exercise device 510 is visible. As with treadmill 10 of FIG. 1, it is intended that the right side of frame 524 be mirror image of the structure discussed relative to the left side. Left frame member 528 and right frame member (not shown) are in spaced-apart, longitudinal relationship. Exercise base 512 also includes a rear support member 530 that is attached to left frame member 528 and right frame member (not shown) at backend 522 of exercise base 512.

Cooperating with frame 524 and a deck 540 is an absorbing assembly 548. The absorbing assembly 548 may be linked or coupled, either directly or indirectly, to frame 524 and deck 540 and provides cushioning to a user exercising upon deck 540. Portions of absorbing assembly 548 are removable and/or replaceable to allow a user to vary the cushioning effect provided to the exercising user. The absorbing assembly 548 allows deck 540 to move towards frame 524, and more generally toward a surface upon which exercise device 510 rests, a sufficient distance to cushion the motion of the exercising user. By so doing, the absorbing assembly 548 limits the potential for user injury through absorbing assembly 548 reducing the force applied by deck 540 to the user as he or she runs, jogs, walks, or generally exercises using exercise device 510. More specifically, deck 540 is movable as the user places his or he foot thereupon. The delay between placing of the foot upon deck 540 and deck 540 stopping its motion towards frame 524 provides cushioning to the exercising user that limits the potential for user injury. The amount of distance traveled and the time taken to travel such a distance reduces the application of a substantially immediate impact force upon the legs of the user as he or she exercises upon the exercise device. The graduated application of the impact force reduces the intensity of the force and reduces the potential for user injury. The degree of displacement or movement of deck 540 may be controlled by the configuration of absorbing assembly 548 and optionally the flexibility of deck 540.

As illustrated in FIG. 21, positioned over the top of deck 540 is an endless belt 532 upon which the user exercises. Two side platforms 544*a* and 544*b*, and optional spacers 547 (FIG. 23), cover a portion of deck 540 and each include a recess 545*a* and 545*b* that receives a fastener, such as a bolt, screw, or other structure that connects a portion of absorbing assembly 548 to deck 540.

Impact absorbing assembly 548 of exercise device 510 is disposed beneath a side of deck 540 and is configured to cushion impact forces applied by a user of exercise device 510 upon deck 540. The cushioning provided by impact absorbing assembly 548 may be adjusted to provide selectable amounts of impact cushioning when a user is operating on deck 540 and/or belt 532. This adjustability enables a user to individualize exercise device 510 for different uses and/or users. Impact absorbing assembly 548 is one structure capable of performing the function of means for cushioning impact upon deck 540. Other configurations of impact absorbing assembly 548 and hence means for cushioning may have an impact absorbing assembly located to the side of deck 540 or at least partially disposed to a side of and beneath deck 540.

The impact absorbing assembly 548 associated with exercise device 510 may include individual absorbing mechanisms 550*a* and 550*b*, which are disposed on opposite sides of frame 524 by way of platform 556 and may extend from deck 540 toward frame 524. Although mention is made to impact absorbing assembly 548 being located at a side of frame 524, while being disposed beneath deck 540, other configurations of the present invention may include absorbing mechanisms that are at least partially disposed between frame 524 and deck 540 and/or extend from deck 540 to a position lower than a portion of frame 524. Similarly, although absorbing mechanisms 550*a* and 550*b* are depicted as being attached to an outside surface of frame 524, it is contemplated, that absorbing mechanisms 550*a* and 550*b* may optionally be attached to the inside surface of frame 524 and perform the desired functions thereof. Furthermore, in other embodiments, absorbing assembly 548 includes one or more absorbing mechanisms and one or more platforms.

With reference now to FIGS. 22 and 23, discussion will be directed to a single absorbing mechanism 550*b*, although one skilled in the art will appreciate that a similar discussion may be made for the absorbing mechanism 550*a* on the opposite side of exercise device 510. Absorbing mechanism 550*b* is mounted to frame 524 by way of a platform 556 that supports absorbing mechanism 550*b* and positions absorbing mechanism 550*b* a distance from a side of frame 524. The absorbing mechanism 550*b* includes, in one embodiment, a first cushioning member 552, a second cushioning member 554, such as, but not limited to, one or more springs, cooperating with cushioning member 552, and cups 560 and 562 coupled to deck 540 and platform 556; cups 560 and 562 maintaining cushioning member 552 relative to second cushioning member 554. In this illustrated configuration, the means for cushioning may include (i) cushioning member 550*b* with or without second cushioning member 554 or (ii) second cushioning member 554 with or without first cushioning member 550*b*. Optionally, the absorbing mechanism and the means for cushioning may include platform 556.

Platform 556 may be attached to frame 524 through use of one or more fasteners 558, such as screws, bolts, or other structures that are capable of attaching platform 556 to frame 524. In this configuration, platform 556 may be rigidly attached or linked to frame 524. Alternatively, platform 556 may be attached or linked in a flexible manner to frame 524. The platform 556 is configured to attach to a lower portion 557 of frame 524, extend from frame 524, and cooperate with absorbing mechanism 550*b*. The platform 556 may alternatively be attached to frame 524 in any manner so long as the platform 556 enables absorbing mechanism 550*b* to at least partially be disposed lower than upper portion 559 of frame 524. For instance, and not by way of limitation, a platform may attach to upper portion 559 or any position between upper portion 559 and lower portion 557 of frame 524 while extending from frame 524 in a manner that positions one end of the absorbing mechanism lower than upper portion 559 of frame 524.

The first cushioning member 552 of absorbing mechanism 550*b* cooperates with platform 556 by way of second cup 562 and a fastener 577, such as a screw, bolt, or other structure capable of connecting cushioning member 552 to platform 556. First cushioning member 552 has a generally cylindrical or barrel shape with a hollow interior 551. A first end 553 of first cushioning member 552 cooperates with first cup 560, while a second end 555 cooperates with second cup 560. The hollow interior 551 allows the sides of first cushioning member 552 to move outwardly from a central axis of first cushioning member 552 as first end 553 moves toward second end 555. As the sides of first cushioning member 552 move, caps 560 and 562 retain first cushioning member 552 and second cushioning member 554 prevents overextension of the sides of cushioning member 552.

In this illustrated configuration, a portion of absorbing mechanism 550*b* and hence first cushioning member 552 and/or second cushioning member 554 may be positioned lower than an upper portion 559 of frame 524 so that the length of absorbing mechanism 550*b* may be longer than the distance between the lower surface of deck 540 and upper portion 559 of frame 540. Positioning absorbing mechanism 550*b* to the side of frame 524 with a portion of absorbing mechanism 550*b* lower than upper portion 559 of frame 524 allows deck 540 to be moved toward upper portion 559 and the surface upon which exercise device 510 rest to a greater degree than would be possible if absorbing mechanism 550*b* were disposed between upper portion 559 and deck 540.

As shown in FIG. 23, deck 540 is separated from a surface upon which exercise device 510 rests by a distance $D_1$. The deck 540 is also separated from upper portion 559 of frame 524 by a distance $D_2$. Distances $D_1$ and $D_2$ change as a user exercises deck 540. Distances $D_1$ and $D_2$ are lessened as the user exercises. In one configuration, absorbing assembly 548 enables distances $D_1$ and $D_2$ to be changed more than about 1 inch upon a force being applied to deck 540. Exercise device 510, therefore, allows deck 540 to move toward the surface upon which the exercise device 510 rests or toward upper portion 559 of frame 524 up to and more than about 1 inch. The same device enables deck 540 to move toward the surface upon which the exercise device 510 rests or upper portion 559 of frame 524 a distance more than about 1 inch for a variety of different forces applied to deck 540. For instance, the forces may range from about 0 lbs to about 1400 lbs resulting in changes in distances $D_1$ and $D_2$ in the range of about 0 inches to greater than about 2 inches.

In another configuration, the change in distances $D_1$ and $D_2$ may be different. For instance, in another configuration, distances $D_1$ and $D_2$ may be changed up to and more than about 1 inch, 1.25 inches, 1.5 inches, 1.75 inches, 2.0 inches, 2.25 inches, or 2.5 inches upon a variety of different force being applied to deck 540 as an exercising user impacts upon deck 540. In another embodiment, distances $D_1$ and $D_2$ may be changed up to and more than about 1.25 inches upon application of 600 lbs of force to deck 540 by an exercising user impacting upon deck 540.

Figure 24:
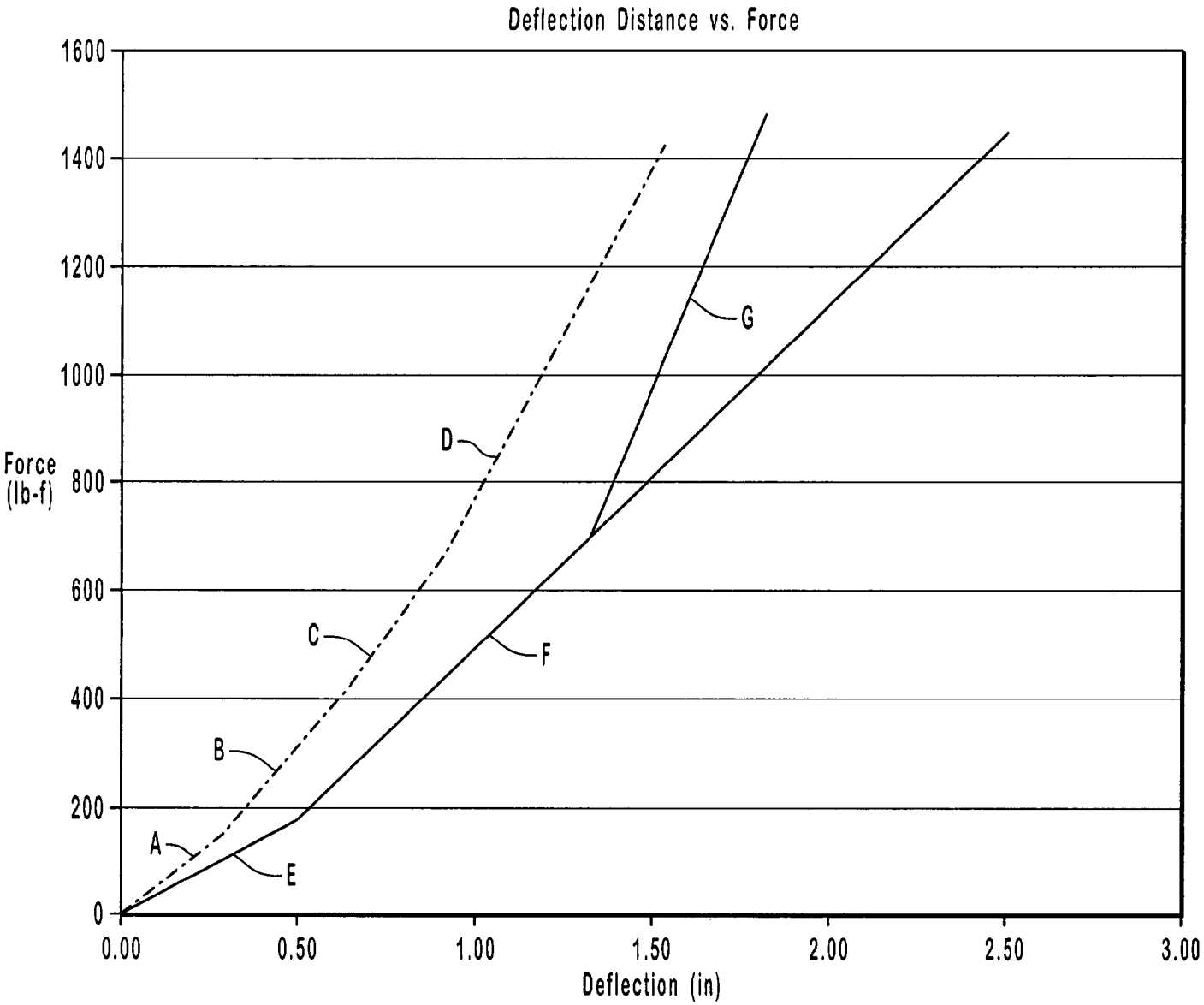
FIG. 24 illustrates a graphical representation of the deflection of the deck of the exercise device of FIG. 20.

According to another aspect of the present invention, by applying various forces to a deck and tracking the associated deflections, illustrative $D_1$ and $D_2$ values may by identified, as illustrated in FIG. 24. FIG. 24 has along its X-axis values representing the deflections of the deck 50 in inches and, along the Y-axis, corresponding impact force values in pounds. These impact force values may be derived by calculating the force required to compress the absorbing mechanism 550*b*. Alternatively, these force/deflection values may be determined empirically.

Linear approximation of the deflection data result in one or more linear equations as follows: for 0 to 0.2 inch deflections, y=535x (illustrated as line "A"), for 0.2 to 0.7 inch deflections, y=648x−23 (illustrated as line "B"); for 0.7 to 1.0 inch deflections, y=780x−115 (illustrated as line "C"), and for 1.0 inch deflection and above, y=1180x−515 (illustrated as line "D"). In another configuration, the linear equations may be as follows: 0.0 to 0.5 inches, y=350x (illustrated by line "E") and for 0.5 inch deflection and above, y=640x−145 (illustrated as line "F"). In another configuration, the linear equations may be as follows: 0.0 to 0.5 inches, y=350x (illustrated by line "E"), for 0.5 to 1.30 inch deflection, y=640x−145 (illustrated as line "F"), and for 1.30 inch deflection and above, y=1840x−1732 (illustrated as line "G").

As may be understood by one skilled in the art, any variation of deflection distance with respect to force applied between the above-defined curves and the X-axis may be possible. For instance, the deflection distance may be greater than the illustrated curve for a force lesser than those indicated by the lines. Stated another way, the deflection distance may have any value defined by the area or region of the graph below the lines illustrated in FIG. 24 and above the X-axis. By providing an exercise with such deflection distances $D_1$ and $D_2$, the present invention aids to limit the potential for injury to the exercising user.

Returning to FIGS. 22 and 23, increasing the available space within which deck 540 may move as a user places his or her foot upon deck 540, enables use of a variety of differently sized cushioning members. The differently sized cushioning members provide differing cushioning characteristics, such as extra large cushioning members that provide maximum cushioning without raising the overall height of the exercise device. This system efficiently enables increased cushioning, without increasing deck height, thereby making the exercise device more convenient to use and store.

Increasing the available space within which deck 540 may move into as a user places his or her foot upon deck 540 also increases the amount of time it takes between placing of the foot upon deck 540 and deck 540 stopping its motion toward frame 524 and the surface upon which exercise device 510 rests. This increase in time delay provides additional cushioning to the exercising user that limits the potential for user injury.

The amount of time between a user placing his or her foot upon deck 540 and deck 540 stopping its motion toward frame 524 may also be controlled by the configuration of cushioning members 552 and 554 and also the particular type of material forming cushioning members 552 and 554. For instance, a cushioning member that is readably compressible may provide a first level of cushioning, while a partially compressible cushioning member provides a second level of cushioning that is lesser than the first level of cushioning. One skilled in the art will appreciate that different materials will provide different levels of cushioning, i.e., have different abilities to compress, deform, or otherwise absorbing impacts.

The configuration of cushioning member 552 and 554 also affects the rebound time from deflection of deck 540 to deck 540 returning to a position before deflection. For instance, although reference is made to first cushioning member 552 having a cylindrical or barrel shape, one skilled in the art may appreciate that first cushioning member 552 may have various other configurations. In another configuration, cushioning member has sides or walls that are uniform or non-uniform dimensions along the length of first cushioning member 552. In another configuration, hollow interior 551 is filled with a fluid, such as a liquid, gas, or combination thereof, which aids in absorbing impact forces applied by a user exercising upon the deck of the exercise device. In still another configuration, the length of first cushioning member 554 may be varied based upon the particular stiffening force desired for use with the exercise device.

Various materials may be used to form first cushioning member 552. For instance, and not by way of limitation, cushioning member may be fabricated from synthetic materials, polymers, plastics, rubber, combinations thereof, or other material that may provide a degree of flexibility or may dissipate impact forces. For instance, cushioning member may include gels, fluids, gases, or any other combination thereof.

In addition to first cushioning member 552 having various configurations, second cushioning member 554 may also have various configurations and be fabricated from various materials to aid in absorbing impact forces and returning the deck of exercise device 510 to a position before application of an impact force by a user exercising upon the deck. For instance, second cushioning member 554 may include one or more springs that have various coil configurations, number of coils, pitch of coils, diameters of wires forming the spring, materials forming the spring, or combinations thereof. The one or more springs may be fabricated from plastics, metals, composites, synthetics, combinations thereof, or other material that provides the desired rebound and absorption requirements. Other second cushioning members are known to those skilled in the art. For instance, second cushioning member 554 may have a similar configuration to first cushioning member 552, with an interior hollow portion thereof being adapted to receive at least a portion of first cushioning member 552 therein.

As shown in FIG. 23, first cup 560 receives first end 553 of first cushioning member 552. The first cup 560 includes a channel 564 that is adapted to receive a portion of second cushioning member 554. The first cup 560 includes a threaded hole 566 that is adapted to receive a fastener 568, such as a screw, bolt or other structure that securely connects first cup 560 to deck 540. The fastener 568 passes through recess 545 of deck 540 to engage with threaded hole 566. Also disposed in cup 560 is a recess 570 that is adapted to receive a portion of first cushioning member 552. The recess 570 may be configured to cooperate with various cushioning members. In other configurations, cup 560 is adapted to cooperate with first cushioning member 552, with or without recess 570.

The second cup 562 is also adapted to receive second cushioning member 554 and includes a channel 572 that may be similar to channel 564. A recess 574 may be disposed in cup 562 to receive second end 555 of first cushioning member 552. Disposed through cup 562 is a hole 576 that cooperates with a fastener 577, such as a screw, bolt or other structure that securely connects cup 562 to platform 556. The fastener 577 attaches to a threaded portion 578 of cushioning member 552 to securely and releasably maintain first cushioning member 552 in contact with cup 562.

Optionally disposed between second cup 562 and platform 556 is a cover 580. Cover 580 may enhance the aesthetic properties of exercise device 510, while optionally aiding with positioning of second cup 562 in the desired location. For instance, cover 580 may include a stop 582 and a lip 584 that together aid in positioning second cup 562 so that fastener 577 may pass through platform 556, cover 580, and second cup 562, to mate with threaded portion 578 of cushioning member 552. The cover 580 may only include one of stop 582 and lip 584 in other configurations. Other configurations of cover 580 may include a recess that receives cushioning member 552 or combinations of recesses, lips, and stops that aid in positioning cushioning member 552.

Exercise device 510 may utilize various springs and cushioning members with absorbing mechanism 550*a*. To exchange the cushioning members or remove a cushioning member, a user may release platform 556 from being attached to frame 524. Upon releasing platform 556, first cushioning member 552 and second cushioning member 554 disengage from first cup 560, while fastener 568 maintains first cup 560 attached to deck 540. Once first cushioning member 552 and second cushioning member 554 are released from first cup 560, a user may replace or remove one or both of cushioning members 552 and 554. Following the selected removal or replacement of one of cushioning members 552 and 554, the user re-engages one or both of the existing or replacement cushioning members 552 and/or spring 554 with first cup 560 and reconnects platform 556 to frame 524.

The above is only one process for exchanging or removing a cushioning from exercise device 510. Other processes are applicable when alternate configurations of absorbing mechanism 550*a* are used. For instance, and not by way of limitation, in the event that a cushioning member threadably engages with first cup 560 and/or second cup 562, the user may need to unscrew the cushioning member during an exchange or removal of the same. Similarly, in the event that the first cushioning member threadably engages with first cup 560 and/or second cup 562, such as with recesses 572 and/or 574, the user may need to unscrew the second cushioning member during an exchange or removal of the same.

In addition to the above described configuration of the absorbing assembly of the present invention, one or more hydraulic or fluid cylinders may be substituted or cooperate with the cushioning member. The hydraulic or fluid cylinder may extend from platform 556 to deck 540, optionally with another cushioning member, such as a spring, partially or completely surrounding a portion of the cylinder. As known to those skilled in the art, a hydraulic or fluid cylinder includes a plunger that moves through an interior chamber. The velocity or speed by which the plunger traverses the interior chamber is controlled by the viscosity of the fluid within the interior chamber and by the size and/or configuration of one or more apertures form in the plunger or a disk attached to an end of the plunger. When the apertures are large, the plunger may move more quickly through the fluid, while small apertures force the plunger to move more slowly through the fluid. Similarly, the viscosity of the fluid varies the speed at which the plunger traverses the interior chamber of the cylinder. By replacing one cylinder with another cylinder having different impact absorbing properties defined by the viscosity of the fluid and the configuration of the one or more apertures, the impact absorbing capabilities of the exercise device may be varied.

The cylinder may be received by first cup 560 and second cup 572. Alternatively, the cylinder may be fixably attached to each cup 560, 572 using one or more fasteners. In another configuration, the cylinder may be releasable attached to deck 540 and/or frame 524, either directly or by way of an intermediate structure, such as but not limited to platform 556.

To vary the capability of the cylinder and the cushioning member to dampen or cushion impact forces applied to deck 524 either or both the cylinder and the cushioning member may be substituted for other cylinders or cushioning members that have differing impact cushioning properties. Changing one cylinder and/or cushioning member for another may be achieved in a similar manner to that described above with respect to FIGS. 21-23.

In another configuration, fluid within a cylinder may be pressurized to different pressures to vary the dampening or cushioning properties of the cylinder. In this configuration, impact cushioning properties of the cylinder may be varied by changing the pressure of the fluid within an interior chamber of the cylinder. Additionally, impact cushioning properties of the impact absorbing mechanism may be varied by changing the cushioning member optionally associated with such a fluid cylinder.

Thus, the present invention relates to exercise devices with an impact absorbing mechanism that is configured to cushion as user's impact. The impact absorbing mechanism may be manipulated to vary the absorbing effect provided to an exercising user. In this manner, embodiments of the present invention provide the exercising user with an exercise device that limits the shock experienced by the user as he or she exercises upon the exercise device and reduces injury to the exercising user.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A treadmill comprising:

a frame having an outside edge;

an endless belt, said belt having an upwardly exposed exercise section;

a deck disposed between said exercise section of said belt and said frame; and a first impact absorbing mechanism coupled to a first side of said deck and said frame, wherein said deck is positioned over said first side of said frame and wherein said first side of said deck extends beyond said outside edge of said first side of said frame away from said exercise section, a second impact absorbing mechanism coupled to a second side of said deck and said frame, wherein each of said first and second impact absorbing mechanisms is configured to cushion impact upon said treadmill, each of said impact absorbing mechanisms comprising:

a cushioning member having a first end and an opposing second end;

a first cup linked to said deck; and a second cup linked to said frame;

wherein said first cup and said second cup receive said cushioning member.

2. The treadmill as recited in claim 1, wherein said first and second impact absorbing mechanisms enables movement of said deck more than about 1.25 inches upon a force of about 600 lbs/foot being applied to said deck.

3. The treadmill as recited in claim 1, wherein said first and second impact absorbing mechanisms comprise at least one cushioning member.

4. The treadmill as recited in claim 1, wherein said first and second impact absorbing mechanisms comprise at least one second cushioning member at least partially disposed about said cushioning member.

5. The treadmill as recited in claim 1, wherein said first and second impact absorbing mechanisms each comprises at least one cushioning member having a variable thickness wall, said variable thickness wall providing different flexibilities to said at least one cushioning member.

6. A treadmill as recited in claim 1, wherein said first impact absorbing mechanism and said second impact absorbing mechanism enable movement of said deck in accordance with at least one of a first relation $y=350x$ for a first range of downward movement and a second relation $y=640x-145$, where x represents the amount of downward movement in inches and y represents the impact force in pounds.

7. The treadmill as recited in claim 6, wherein the first relation governs deflection of said first absorbing mechanism and said second impact absorbing mechanism between about 0 inches and about 0.5 inches.

8. The treadmill as recited in claim 6, wherein the second relation governs deflection of said first absorbing mechanism and said second impact absorbing mechanism greater than about 0.5 inches.

9. The treadmill as recited in claim 6, wherein said first impact absorbing mechanism and said second impact absorbing mechanism enable movement of said deck in accordance with a third relation $y=1840x-1732$ for a deflection of greater than about 1.30 inches.

10. The treadmill as recited in claim 6, wherein said first impact absorbing mechanism and said second impact absorbing mechanism enable movement of said deck by a downward movement greater than defined by at least one of said first relation and said second relation for a given force.

11. A treadmill as recited in claim 1, wherein said first impact absorbing mechanism and said second impact absorbing mechanism enable movement of said deck in accordance with a first relation $y=648x-23$, where x represents the amount of movement in inches and y represents the impact force in pounds.

12. The treadmill as recited in claim 11, wherein said first relation governs movement of said first impact absorbing mechanism and said second impact absorbing mechanism between about 0.2 inches and about 0.7 inches of deflection.

13. The treadmill as recited in claim 11, wherein said first impact absorbing mechanism and said second impact absorbing mechanism enable movement of said deck in accordance with a second relation $y=535x$ between about 0 inches and about 0.2 inches of deflection.

14. The treadmill as recited in claim 11, wherein said first impact absorbing mechanism and said second impact absorbing mechanism enable movement of said deck in accordance with a second relation $y=780x-115$ between about 0.7 inches and about 1.0 inches of deflection.

15. The treadmill as recited in claim 11, wherein said first impact absorbing mechanism and said second impact absorbing mechanism enable movement of said deck in accordance with a third relation $y=180x-515$ for a deflection of greater than about 1.0 inches.

16. The treadmill as recited in claim 11, wherein said first impact absorbing mechanism and said second impact absorbing mechanism enable movement of said deck by a downward movement greater than defined by said first relation for a given force.

17. The treadmill as recited in claim 1, wherein said first impact absorbing mechanism and said second impact absorbing mechanism enable movement of said deck more than 1.5 inches.

18. A treadmill comprising:

a frame comprising a lower portion, wherein said lower portion has a securing location;

a platform linked to said lower portion of said frame at said securing location and extending therefrom;

an endless belt, said belt having an upwardly exposed exercise section;

a deck disposed between said exercise section of said belt and said frame, wherein at least a portion of said deck extends beyond said securing location of said frame away from said exposed exercise section when the treadmill is positioned on a support surface for use by a user; and an impact absorbing mechanism linked to said platform and said deck, said impact absorbing mechanism being configured to cushion an impact upon said deck, said impact absorbing mechanism comprising:

a cushioning member;

a first cup linked to said deck; and a second cup linked to said platform;

wherein said first cup and said second cup retain said cushioning member.

19. The treadmill as recited in claim 18, wherein said impact absorbing mechanism enables movement of said deck more than about 1.25 inches upon application of 600 lbs of force to said deck.

20. The treadmill as recited in claim 18, wherein said impact absorbing mechanism enables movement of said deck more than about 1.5 inches.

21. The treadmill as recited in claim 18, wherein said impact absorbing mechanism enables movement of said deck more than about 2.0 inches.

22. The treadmill as recited in claim 18, wherein said impact absorbing mechanism enables movement of said deck more than about 2.5 inches.

23. The treadmill as recited in claim 18, wherein said impact absorbing mechanism further comprises at least one second cushioning member.

24. The treadmill as recited in claim 16, wherein said cushioning member comprises a variable thickness wall.

25. The treadmill as recited in claim 18, wherein said impact absorbing mechanism enables movement of said deck more than about 1 inch.

26. The treadmill as recited in claim 18, wherein said first cup and said second cup support a spring substantially surrounding said cushioning member.

27. The treadmill as recited in claim 25, wherein said platform links said second cup to said frame, wherein said platform is removably linked to said frame.

28. The treadmill as recited in claim 18, wherein said platform is normal to at least a portion of said frame.

29. A treadmill comprising:

a frame having a lower portion;

a platform rigidly coupled to said lower portion and extending laterally therefrom;

an endless belt having an upwardly exposed exercise section;

a deck disposed between said exercise section of said belt and said frame; and an impact absorbing mechanism coupled to said deck and said platform and configured to cushion impact upon said deck, said impact absorbing mechanism comprising a cushioning member cooperating with said deck and said platform, said cushioning member being disposed between a first cup linked to said deck and a second cup linked to said platform thereby positioning said cushioning member to the side of said frame away from said exposed exercise section of said endless belt.

30. The treadmill as recited in claim 29, wherein said cushioning member enables movement of said deck more than about 1.25 inches upon application of 600 lbs of force to said deck.

31. The treadmill as recited in claim 29, wherein said cushioning member enables movement of said deck by a distance selected from the group consisting of more than about 1 inch, more than about 1.5 inches, more than about 2 inches, or more than about 2.5 inches.

32. The treadmill as recited in claim 29, wherein said cushioning member is adapted to be at least partially compressed, while having a biasing force to move said deck in a substantially vertical direction following compressing of said cushioning member.

33. The treadmill as recited in claim 29, wherein said impact absorbing mechanism further comprises at least one second cushioning member, said at least one second cushioning member being adapted to be at least partially compressed.

34. The treadmill as recited in claim 33, wherein said at least one second cushioning member at least partially surrounds said cushioning member.

* * * * *

UNITED STATES PATENT AND TRADEMARK OFFICE

CERTIFICATE OF CORRECTION

PATENT NO. : 7,563,203 B2
APPLICATION NO. : 10/377295
DATED : July 21, 2009
INVENTOR(S) : Dalebout et al.

It is certified that error appears in the above-identified patent and that said Letters Patent is hereby corrected as shown below:

The title page showing the illustrative figure should be deleted to be replaced with the attached title page Title Page
Item 57, Abstract, Line 8, change "at least cushioning member and at least" to --at least one cushioning member and at least--
Item 56, Other Publications, Page 2, remove the second instance of [and with English translation (3 pages)]

Drawings
The drawing sheet, consisting of Fig. 23, should be deleted to be replaced with the drawing sheet, consisting of Fig. 23, as shown below Replace Figure 23 with the figure depicted herein below, wherein hole 576 is labeled and threaded portion 558 is relabeled 578. Also, one instance of 524 is removed

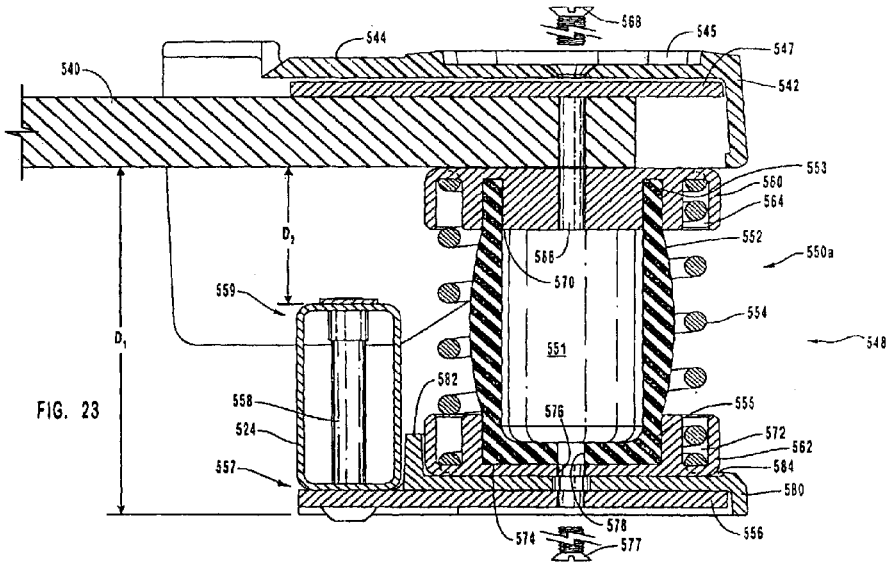

FIG. 23

Signed and Sealed this

Seventh Day of September, 2010

David J. Kappos

David J. Kappos
*Director of the United States Patent and Trademark Office*

Column 1
Line 34, change “elongate” to --elongated--

Column 2
Line 15, change “applied to” to --applied as--
Line 23, insert --,-- after “herein”
Line 62, change “thatextends” to --that extends--

Column 4
Line 40, change “17a” to --16a--

Column 7
Line 3, change “function” to --functions--

Column 9
Line 44, change “92” to --82--
Line 47, change “82” --92--
Line 49, insert --,-- after “84”
Line 50, insert --,-- after “92”

Column 10
Line 13, insert --a-- before “structure”

Column 12
Line 66, remove [30]

Column 14
Line 48, change “amount-of” to --amount of--

Column 16
Line 46, change “320a-302c” to --320a-320c--

Column 17
Line 2, change “31.6a-316c” to --316a-316c--

Column 19
Line 11, change “on” to --one--
Line 32, change “324a” to --324--

Column 20
Line 60, change “backend” to --back end--

Column 21
Line 3, remove [,] after “rests”
Line 55, remove [,] after “contemplated”
Line 62, change “550b” to --550a--
Line 64, change “550a” to --550b--
Line 65, change “550b” to --550a--
Line 67, change “550b” to --550a--

Column 22
Line 1, change “550b” to --550a--
Line 2, change “550b” to --550a--
Line 9, change “550b” to --552--
Line 12, change “550b” to --552--
Line 43, change “caps” to --cups--
Line 57, change “rest” to --rests--

Column 23
Line 15, change “force” to --forces--
Line 25, change “50” to --540--

Column 24
Line 20, change “member” to --members--

Column 26
Line 4, change “form in the plunger or a disk” to --formed in the plunger or disk--
Line 16, change “572” to --562--
Line 17, change “572” to --562--
Line 18, change “releasable” to --releasably--
Line 23, insert --,-- after “524”

Column 27
Line 13, change “enables” to --enable--
Line 36, insert --impact-- after “first”
Line 40, insert --impact-- after “first”

Column 28
Line 9, change “y=180x-515” to --y=1180x-515--
Line 60, change “16” to --23--

(12) United States Patent
Dalebout et al.

(10) Patent No.: US 7,563,203 B2
(45) Date of Patent: Jul. 21, 2009

(54) TREADMILL WITH ADJUSTABLE CUSHIONING MEMBERS

(75) Inventors: William T. Dalebout, N. Logan, UT (US); Gordon L. Cutler, Providence, UT (US); Rodney L. Hammer, Lewiston, UT (US); Justin Quinn Ferre, Logan, UT (US)

(73) Assignee: Icon IP, Inc., Logan, UT (US)

( * ) Notice: Subject to any disclaimer, the term of this patent is extended or adjusted under 35 U.S.C. 154(b) by 604 days.

(21) Appl. No.: 10/377,295

(22) Filed: Feb. 28, 2003

(65) Prior Publication Data

US 2003/0153434 A1 Aug. 14, 2003

Related U.S. Application Data

(60) Continuation-in-part of application No. 09/953,589, filed on Sep. 12, 2001, now Pat. No. 6,821,230, which is a continuation-in-part of application No. 09/777,141, filed on Feb. 5, 2001, now Pat. No. 6,652,424, which is a continuation of application No. 09/437,387, filed on Nov. 10, 1999, now Pat. No. 6,280,362, which is a division of application No. 09/160,947, filed on Sep. 25, 1998, now Pat. No. 6,174,267.

(51) Int. Cl.
*A63B 22/02* (2006.01)

(52) U.S. Cl. ..... 482/54; 482/51

(58) Field of Classification Search ..... 482/51, 482/54; 119/700

See application file for complete search history.

(56) References Cited

U.S. PATENT DOCUMENTS 3,592,466 A 7/1971 Parsons
3,689,066 A 9/1972 Hagen
4,350,336 A 9/1982 Hanford
4,509,510 A 4/1985 Hook (Continued)

FOREIGN PATENT DOCUMENTS

CN 2387928 7/2000

(Continued)

OTHER PUBLICATIONS

Kutz, M., ed., Mechanical Engineer's Handbook, 2nd ed., New York: John Wiley & Son, Inc., 1998.

(Continued)

*Primary Examiner*—Glenn Richman
(74) *Attorney, Agent, or Firm*—Workman Nydegger

(57) ABSTRACT

An exercise device includes a frame with a deck cooperating with the frame. The deck and frame cooperate with an endless belt having an upwardly exposed exercise section upon which an exercising user may rest or exercise. An impact absorbing mechanism cooperates with the frame and the deck and is configured to adjustably cushion the impact of a user upon the exercise section of the endless belt. The impact absorbing mechanism includes at least cushioning member and at least one spring at least partially surrounding a portion of the at least one cushioning member, wherein adjustment of the impact absorbing mechanism is achieved by replacing at least one of the at least one cushioning member and the at least one spring with at least one of another cushioning member and another spring.

34 Claims, 19 Drawing Sheets

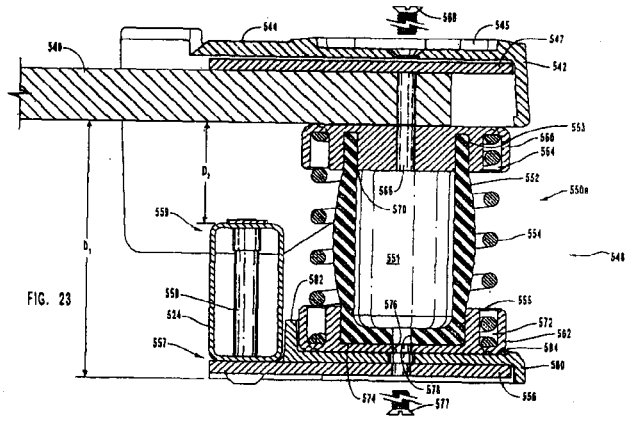

FIG. 23